US007722508B2

(12) United States Patent
Hetrick

(10) Patent No.: US 7,722,508 B2
(45) **Date of Patent: *May 25, 2010**

(54) COMBINATION GRIP FOR AN EXERCISE DEVICE

(75) Inventor: Randal Hetrick, San Francisco, CA (US)

(73) Assignee: Fitness Anywhere, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/948,876

(22) Filed: Nov. 30, 2007

(65) Prior Publication Data

US 2008/0076642 A1 Mar. 27, 2008

Related U.S. Application Data

(63) Continuation of application No. 11/557,050, filed on Nov. 6, 2006, which is a continuation-in-part of application No. 10/714,388, filed on Nov. 14, 2003, now Pat. No. 7,090,622, which is a continuation-in-part of application No. 10/410,691, filed on Apr. 9, 2003, now Pat. No. 7,044,896.

(51) Int. Cl.
*A63B 21/068* (2006.01)

(52) U.S. Cl. ..... 482/95; 482/139; 482/148; 482/904; 482/907

(58) Field of Classification Search ..... 482/23, 482/24, 33, 37, 49, 69, 91, 95, 96, 120, 131, 482/139, 141, 143, 148, 907
See application file for complete search history.

(56) References Cited

U.S. PATENT DOCUMENTS 3,411,776 A * 11/1968 Holkesvick et al. ..... 482/120
3,462,142 A * 8/1969 Sterndale ..... 482/120
3,532,189 A 10/1970 Wade ..... 188/65.3
3,608,900 A * 9/1971 Welch ..... 482/120
3,677,543 A * 7/1972 Richardson ..... 482/129
3,752,474 A * 8/1973 Macabet et al. ..... 482/131

(Continued)

FOREIGN PATENT DOCUMENTS

AU 727828 B 1/2001

(Continued)

OTHER PUBLICATIONS

Hetrick, Randal, co-pending U.S. Appl. No. 11/296,196, filed Dec. 7, 2005.

(Continued)

*Primary Examiner*—Loan H Thanh
*Assistant Examiner*—Victor K Hwang
(74) *Attorney, Agent, or Firm*—Steven R. Vosen

(57) ABSTRACT

An exercise device having many advantageous features is described, including the ability to provide a combination of grips to the user, and the ability to easily mount the device to a wall. One exercise device described is an inelastic resistance device having a combination grip that includes hand grips and a loop. The hand grip and loop may be used as a foot grip, or alternatively, just the hand grip can be used by the hand. The selection of a specific accessory grip allows the user to exercise by specific body parts and provides for a greater number of possible exercises.

20 Claims, 26 Drawing Sheets

U.S. PATENT DOCUMENTS

| | | | | | |
|---|---|---|---|---|---|
| 4,060,240 | A * | 11/1977 | Dunston | 482/131 |
| 4,343,466 | A * | 8/1982 | Evans | 482/120 |
| 4,685,671 | A * | 8/1987 | Hagerman et al. | 482/124 |
| 5,069,449 | A * | 12/1991 | Wardwell | 482/13 |
| 5,176,602 | A * | 1/1993 | Roberts | 482/131 |
| 5,254,065 | A * | 10/1993 | Pollock | 482/129 |
| 5,258,017 | A * | 11/1993 | Myers et al. | 606/241 |
| 5,370,286 | A * | 12/1994 | Newman | 224/578 |
| 5,505,677 | A * | 4/1996 | Hinds | 482/10 |
| 5,569,140 | A | 10/1996 | Elliman | 482/140 |
| 5,571,064 | A * | 11/1996 | Holm | 482/129 |
| 5,807,214 | A * | 9/1998 | Riazi | 482/129 |
| 5,921,903 | A * | 7/1999 | Lawrence | 482/140 |
| 6,102,837 | A * | 8/2000 | Hubbard | 482/120 |
| 6,338,700 | B1 * | 1/2002 | Pollock | 482/95 |
| 6,450,929 | B1 * | 9/2002 | Markham | 482/121 |
| 6,726,606 | B2 * | 4/2004 | Jacobsen | 482/121 |
| 6,921,354 | B1 * | 7/2005 | Shifferaw | 482/91 |
| 7,044,896 | B2 * | 5/2006 | Hetrick | 482/95 |
| 7,090,622 | B2 * | 8/2006 | Hetrick | 482/92 |
| 7,438,674 | B2 * | 10/2008 | Sjodin | 482/91 |
| 2002/0022555 | A1 * | 2/2002 | Nesci | 482/91 |
| 2006/0116252 | A1 * | 6/2006 | Hetrick | 482/91 |
| 2007/0027005 | A1 * | 2/2007 | Hetrick | 482/91 |
| 2007/0066450 | A1 * | 3/2007 | Hetrick | 482/91 |

FOREIGN PATENT DOCUMENTS

| | | | |
|---|---|---|---|
| DE | 19527241 | A1 | 1/1997 |

OTHER PUBLICATIONS

Hetrick, Randal, co-pending U.S. Appl. No. 11/419,320 filed May 19, 2006.

Hetrick, Randal, co-pending U.S. Appl. No. 11/557,050, filed Nov. 6, 2006.

Hetrick, Randal, co-pending U.S. Appl. No. 11/948,860, filed Nov. 30, 2007.

Hetrick, Randal, co-pending U.S. Appl. No. 11/948,863, filed Nov. 30, 2007.

Hetrick, Randal, co-pending U.S. Appl. No. 11/948,868, filed Nov. 30, 2007.

Hetrick, Randal, co-pending U.S. Appl. No. 11/948,872, filed Nov. 30, 2007.

Hetrick, Randal, co-pending U.S. Appl. No. 11/948,875, filed Nov. 30, 2007.

* cited by examiner

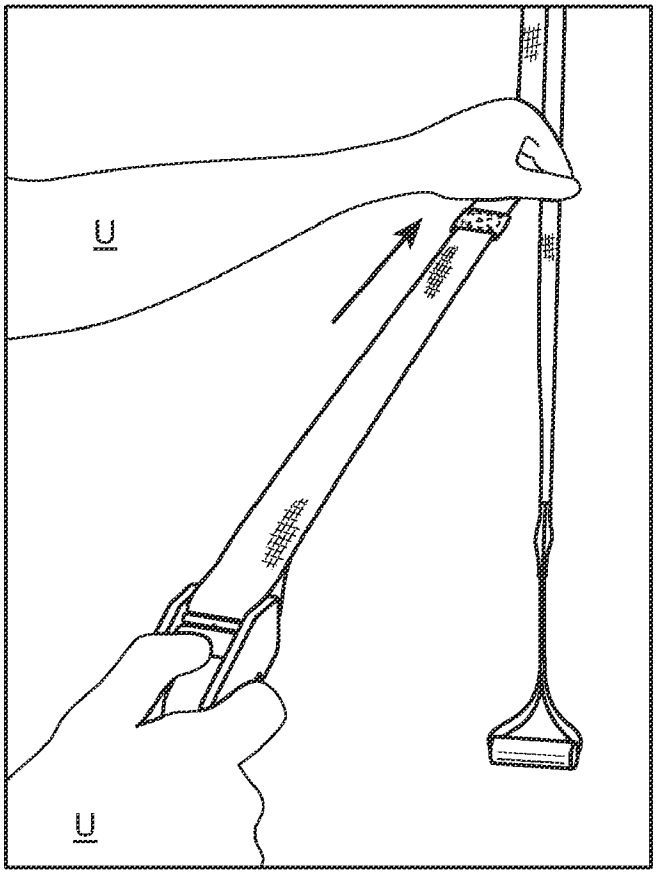
FIG. 12B'
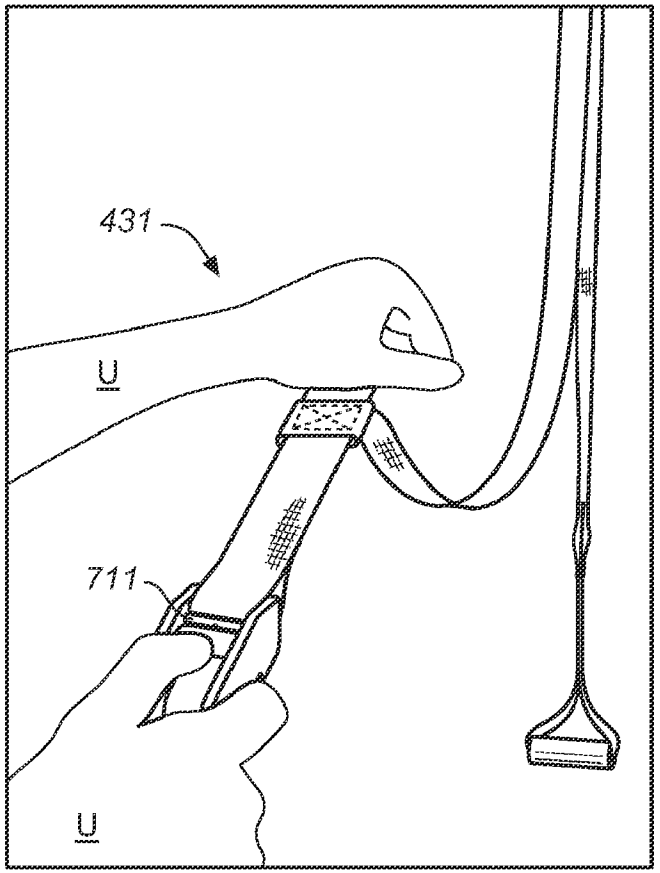
FIG. 12B"

COMBINATION GRIP FOR AN EXERCISE DEVICE

CROSS-REFERENCE TO RELATED APPLICATIONS

This application is a continuation of U.S. patent application Ser. No. 11/557,050 filed Nov. 6, 2006, which is a continuation-in-part of U.S. patent application Ser. No. 10/714,388 filed on Nov. 14, 2003, issued as U.S. Pat. No. 7,090,622, which is a continuation-in-part of U.S. patent application Ser. No. 10/410,691 filed on Apr. 9, 2003, issued as U.S. Pat. No. 7,044,896. The entire contents of each of the above-listed applications are hereby incorporated by reference herein and made part of this specification.

FIELD OF THE INVENTION

The present invention generally relates to exercise devices, and in particular, to grips for an exercise device having an inelastic strap that is easily configurable for use in performing a wide variety of exercises.

BACKGROUND OF THE INVENTION

Resistance exercise devices allow a user to exercise by providing a resistance to the movement of a user's arms, legs, or torso. The term "resistance exercise device" as used herein denotes exercise devices where resistance is provided by working one muscle against another, or by working against the weight of the user, and may include elastic bands to provide an increased resistance force. More specifically, resistance exercise devices, as used herein, do not include a significant or additional weight against which the user exercises. The usefulness of these devices depends, in part, on the ease with which a user can perform different types of exercises, the range or number of exercises that can be performed with the device, and the ease with which different users can adjust the device according to their height, weight, strength, and/or physical limitations. In addition, resistance exercise devices are often lightweight and may be portable.

Resistance exercise devices having elastic bands typically restrict the motion of a user's arms and/or legs, or the motion between the user and a support structure. Elastic exercise devices can be small, even portable, but have limited usefulness that result from their resistance characteristics, which depend on the length and elasticity of the elastic band. As a result of these characteristics, the elastic bands are useful for a specific length range, thus restricting the diversity of exercises for which it can be used. In addition, it may not be possible for different users to use the same device for the same exercise due to differences in height, weight, or strength between different users. Thus, for an elastic device to be generally useful, such as to provide a complete workout or to allow for different users, a plurality of elastic bands are required that must be easily interchangeable. No known prior art device provides the ease of use necessary to be generally useful across a wide range of exercises.

Another limitation of elastic resistance exercise devices is that the resistance is inconsistent and increases with increasing displacement, and also tends to snap back when the user decreases his or her effort. While this resistance response provides for a compact design, it is problematic as it does not recreate the resistance encountered by muscles during more natural types of exercising, such as running, swimming, etc. Yet another limitation of elastic devices is the inability to support a wide range of weight of the user—typically the devices are adapted to support only the resistance provided by the user's muscles. This creates extreme limitations in the exercises that can be performed by any individual elastic device. For this reason, elastic devices must be used over a limited range of stances, further limiting the user's workout.

Another type of resistance exercise device provides an inelastic strap that is attachable to a fixed location such as, for example, a door. These devices may overcome some of the limitations of the elastic devices previously discussed by providing inelastic straps that can be anchored between a door and a door jamb. One of these devices has a fixed length strap attached to a door through a pulley system that allows the user to exercise by moving the arms in opposite directions. Another of these devices has a pair of fixed length straps anchored to a door. Both of these devices are of limited usefulness because of their fixed length and the range of exercises for which they can be used.

There is a need to provide a resistance exercise device that is easily adjustable so that it can provide a complete workout for any user, including adjustments that allow a wide range of stances and exercises, and that provides resistance to the user's motion in a form that is useful for exercising.

SUMMARY OF THE INVENTION

In one embodiment, an exercise device comprises an inelastic portion having grips of different types. The device, which may include an anchor for fixing the device to a stationary object, is preferably adjustable over a range of lengths, and that can provide resistance ranging from nearly zero to the full body weight of the user.

As used herein, the noun "grip" encompasses any device that is interlockable with part of the human body, that is it can be connected in such a way that a person can transfer a force to the grip, preferably a force equal to some or all of the person's weight, and the verb "grip," when used herein, refers to the action of interlocking the device and a body part. When used in an exercise device, a grip is attached to other elements that permit the force to be transferred to another object, including but not limited to a stationary support, a device that can store or release energy, such as an elastic cord or a spring, or another body part. Grips include devices that can be surrounded by a body part, for example flexible loop or a hook, or that a body part can surround, for example an elongated member that can fit within the grasp of the hand. In this context, a member that can be gripped, or is grippable, is one that can surround a body part or can be surrounded by a body part, and has a size and configuration that permits the transfer of forces from the user to the grip. A "hand grip" is grip that is sized for grasping by the hand.

In certain embodiments, an inelastic exercise device is provided that includes an elongated member and an anchor. The elongated member has a pair of ends separated by a length and a mechanism for adjusting the length. Further, the elongated member is a substantially inelastic and flexible material. The pair of ends includes a first end having a first grip and a second end having a second grip. The anchor has a first portion for mounting to a structure and a second portion including a flexible portion to support the elongated member at a position along the length when both of said grips are pulled in a direction away from the anchor. The flexible portion includes a loop, and the elongated member passes through the loop.

In certain other embodiments, an inelastic exercise device is provided that includes an elongated member and an anchor. The elongated member has a pair of ends separated by a length, and the pair of ends includes a first end having a first grip and a second end having a second grip. The elongated member includes at least one inelastic, flat strap. The anchor has a first portion for mounting to a structure and a second portion including a flexible portion to support the elongated member at a position along the length when both of said grips are pulled in a direction away from the anchor. The flexible portion includes a loop, and the elongated member passes through the loop.

Certain embodiments are summarized above. However, despite the foregoing discussion of certain embodiments, only the appended claims (and not the present summary) are intended to define the invention(s). The summarized embodiments, and other embodiments, will become readily apparent to those skilled in the art from the following detailed description of the preferred embodiments having reference to the attached figures, the invention(s) not being limited to any particular embodiment(s) disclosed.

BRIEF DESCRIPTION OF DRAWINGS

FIG. 5A is a perspective view, and FIG. 5B is sectional view 5B-5B;

FIG. 12A is the initial configuration, FIG. 12B illustrates lengthening the elongated member, further illustrated in FIGS. 12B' and 12B", FIG. 12C shows the application of force to the shorter leg of the elongated member, and FIG. 12D shows the application of force to the grips during an exercise;

FIG. 13A is the initial configuration, FIG. 13B shows the application of force to one of the pair of legs, and FIG. 13C shows the application of force to the grips during an exercise;

FIG. 15A is a reverse combination crunch, FIG. 15B is a single leg L-squat, FIG. 15C is a gymnast dip, FIG. 15D is a kneeling combination crunch, FIG. 15E is a lying leg curl, FIG. 15F is a hip lift, FIG. 15G is a front shoulder raise, FIG. 15H is a crunch, and FIG. 15I is a triceps extension;

FIG. 16A shows interlocking the handles for one handed exercises, and FIG. 16B illustrates the use of the exercise device in performing a one arm high row exercise;

FIG. 17A illustrates the foot grip accessory gripped by the user's toes, and FIG. 17B illustrates a pair of foot grip accessories with one accessory on each of the pair of grips of an exercise device and grasped by one of the user's heels;

FIG. 18A is a perspective view of the foot grip accessory, FIG. 18B is a bottom view of the foot grip accessory, FIG. 18C is a side view of part of one of the grip attachment portions, and FIG. 18D is a top view of part of one of the grip accessory attachment portions;

FIG. 19A illustrates the one finger placed through one of the loops, FIG. 19B illustrates one finger be placed through each of the two loops, and FIG. 19C shows two fingers placed through each of the two loops;

FIG. 20A is a perspective view of the finger grip accessory, FIG. 20B is a top view 20B-20B of the finger grip accessory, and FIG. 20C is a sectional side view 20C-20C of the finger grip accessory;

FIG. 21A illustrates a hand gripping three cords, FIG. 21B illustrates the hand gripping two cords, and FIG. 21C illustrates the hand gripping one cord;

FIG. 22A is a perspective view of the grip accessory, FIG. 22B is a top view of the grip accessory, FIG. 22C is a bottom view of the grip accessory, and FIG. 22D is sectional side view 22D-22D of FIG. 22C;

FIG. 25 is a perspective front view of a bracket for mounting an exercise device, and FIG. 26 illustrates the use of the bracket to anchor the exercise device;

Reference symbols are used in the Figures to indicate certain components, aspects or features shown therein, with reference symbols common to more than one Figure indicating like components, aspects or features shown therein.

DETAILED DESCRIPTION

For purposes of contrasting various embodiments with the prior art, certain aspects and advantages of these embodiments are described where appropriate herein. Of course, it is to be understood that not necessarily all such aspects or advantages may be achieved in accordance with any particular embodiment. Modifications and variations can be made by one skilled in the art without departing from the sprit and scope of the invention including, but not limited to: the use of inelastic members, which are described herein as straps, that are round or have some other cross-sectional shape, and/or which are formed from two or more members joined together, as by stitching or with an adhesive; or the use of different mechanisms for adjusting the length of inelastic member that are known in the field including, but not limited to, buckles, hooks, or winding the inelastic member about a rigid element. Moreover, any one or more features of any embodiment may be combined with any one or more other features of any other embodiment, without departing from the scope of the invention.

Figure 2:
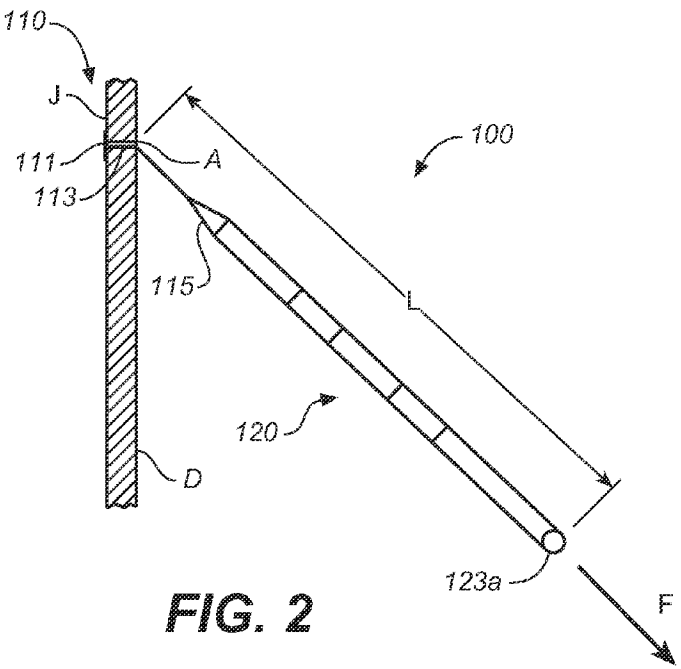
FIG. 2 is a partial schematic sectional view 2-2 of FIG. 1 showing the exercise device anchored between a door and doorjamb.
Figure 1:
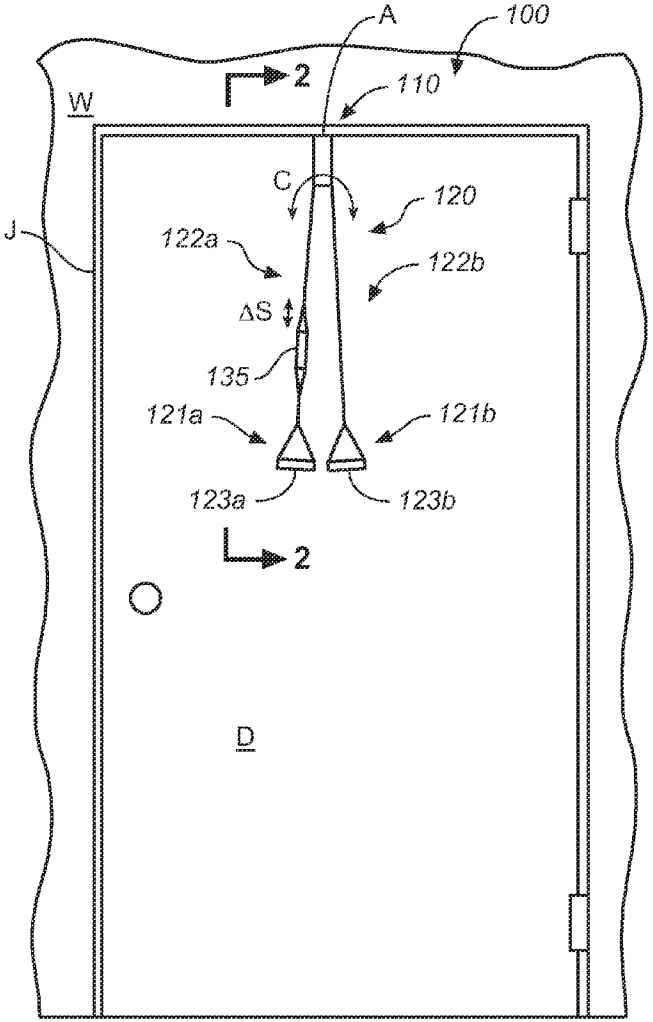
FIG. 1 is a schematic front view of one embodiment of an exercise device as anchored between a door and door jamb.

Disclosed herein is an inelastic exercise device that is supported by, or that can be easily attached to, a supporting structure, and that allows a user to perform a large number of exercises by easily adjusting the length of the device and thereafter balancing the device as the user transfers his weight to the device. Several of the features will now be illustrated with reference to FIGS. 1-3. FIG. 1 is a schematic front view of one embodiment of exercise device 100 that is anchored at a point A between a door D and door jamb J. FIG. 2 is a partial sectional view 2-2 of FIG. 1 taken through door D and showing exercise device 100 in profile, and FIG. 3 is illustrative of a user U exercising with the exercise device of FIG. 1.

Exercise device 100 includes an anchor 110 and an elongated member 120 having a pair of arms 122, indicated as a first arm 122*a* and a second arm 122*b*, on either side of the anchor, as shown schematically in FIGS. 1 and 2. A pair of grips 123 is provided, with one positioned at each end 121 of each arm 122, specifically first arm 122*a* has a first grip 123*a*, and second arm 122*b* has a second grip 123*b*. Elongated member 120 is substantially inelastic and flexible with a length S between the pair of grips 123, and includes a strap or cord or other inelastic, flexible member, and a lengthening mechanism 135 that provides for increasing or decreasing the length S, as indicated by double arrows ΔS.

Figure 3:
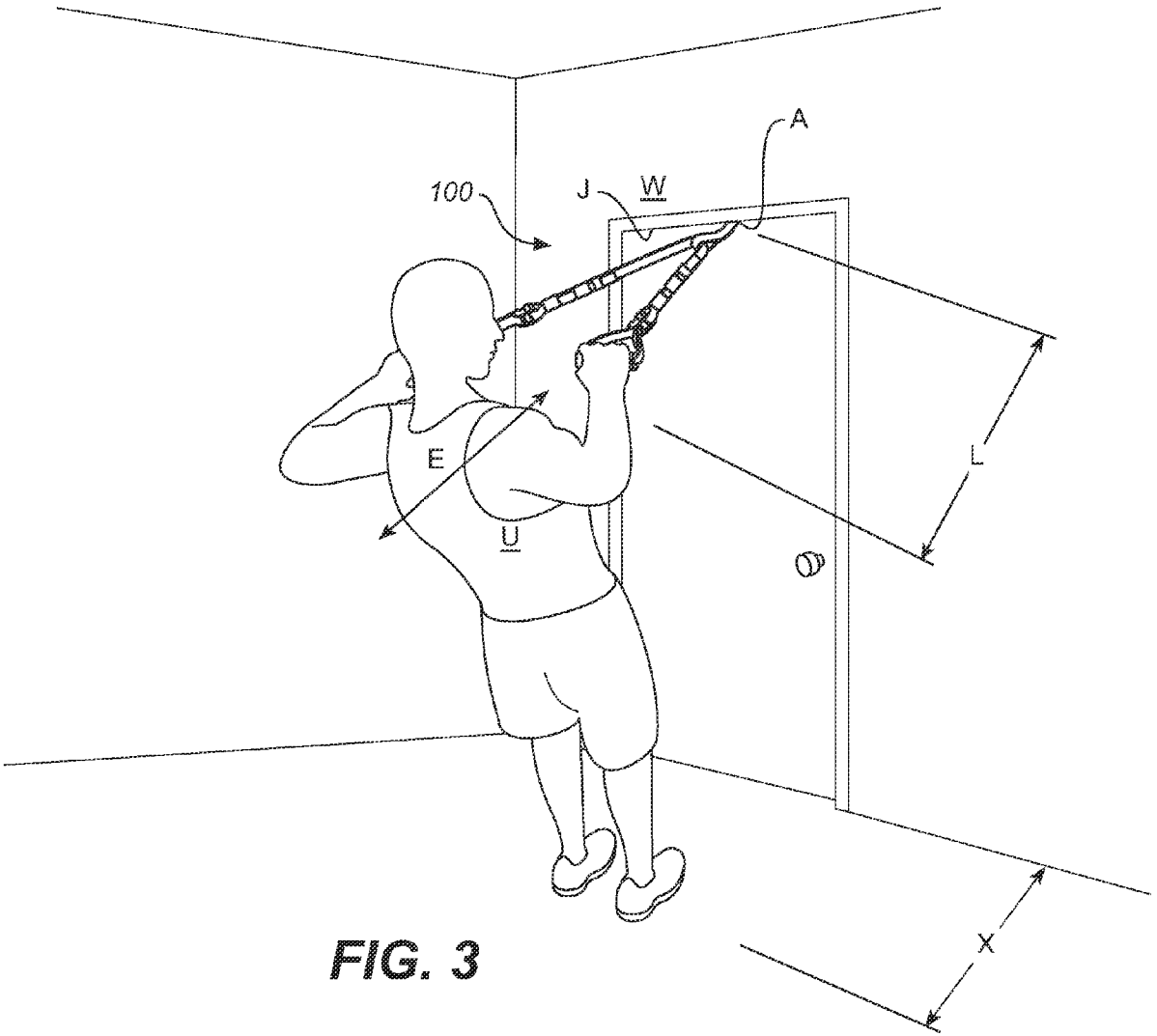
FIG. 3 is illustrative of a user performing a high row exercise with the exercise embodiment of FIG. 1.

Anchor 110 is used to provide a fixed anchor point for exercise device 100 and to support a user's weight as it is applied to arms 122 as indicated by an arrow F in FIG. 2 and as shown in FIG. 3. As shown in FIG. 2, anchor 110 is adapted for positioning exercise device 100 in a door and providing support to elongated member 120 by having an enlarged portion 111, a portion 113 that can be strap or cord, and an approximately triangular shaped loop 115 for slidably supporting the elongated member. With enlarged portion 111 on the opposite side of door D from elongated member 120, anchor 110 supports the weight of a user as grips 123 are pulled. In addition, anchor 110 provides for positioning the relative length of arms 122 as shown in FIG. 1 by double arrow C. Thus, the total length of elongated member 120 and distribution of that length between each of arms 122 can be easily adjusted through the lengthening mechanism 135 and by pulling the ends of the elongated member. FIG. 2 shows arms 122 each having a length L.

When supported by a structure, such as door D (shown in FIGS. 1-3) or a railing, pole or other support member (not shown) the inventive exercise device provides a pair of grips for a user to exercise against her weight according the user's position relative to the device, and provides for easily adjusting the length of the device. As described below, the inventive device can be used to exercise in any one of a large number of orientations according the selected adjustable length and according to where and how the user stands relative to the exercise device. In general, a user sets the exercise device to a desired length, positions herself on the ground near the exercise device, supports a portion of her body weight from the exercise device by her hands or feet, and exercises by moving her body with her weight supported by the ground and the exercise device. Examples of support on the ground and exercise device include, but are not limited to, standing on one or both legs, lying on the stomach or the back, kneeling, or by having the hands on the ground, and having the exercise device support ones weight by the hands or feet, as appropriate.

With reference to FIG. 3, a user U is shown in one of the many exercise positions, in particular a high row exercise, gripping the pair of grips 123 with the user's hands and having the user's feet placed a horizontal distance X from anchor point A. When anchored to a door, it is preferred that anchor point A is on the inwards side of the door (that is, that the door open away from user U) so that jamb J can support the user's weight. The user U is shown leaning away from anchor point A and supporting a fraction of his or her weight through device 100. It is apparent that user U can vary the amount of supported weight, and thus the resistance of exercise device 100, by adjustment of his or her stance relative to anchor point A (distance X) and the length of arms 122 (length L). The user U of FIG. 3 performs a high row exercise by moving his body in a direction E towards and away from anchor point A. Note that other exercises are also possible with the user in this position by the user moving in other directions with the user's weight supported by the ground and exercise device 100.

Figure 4:
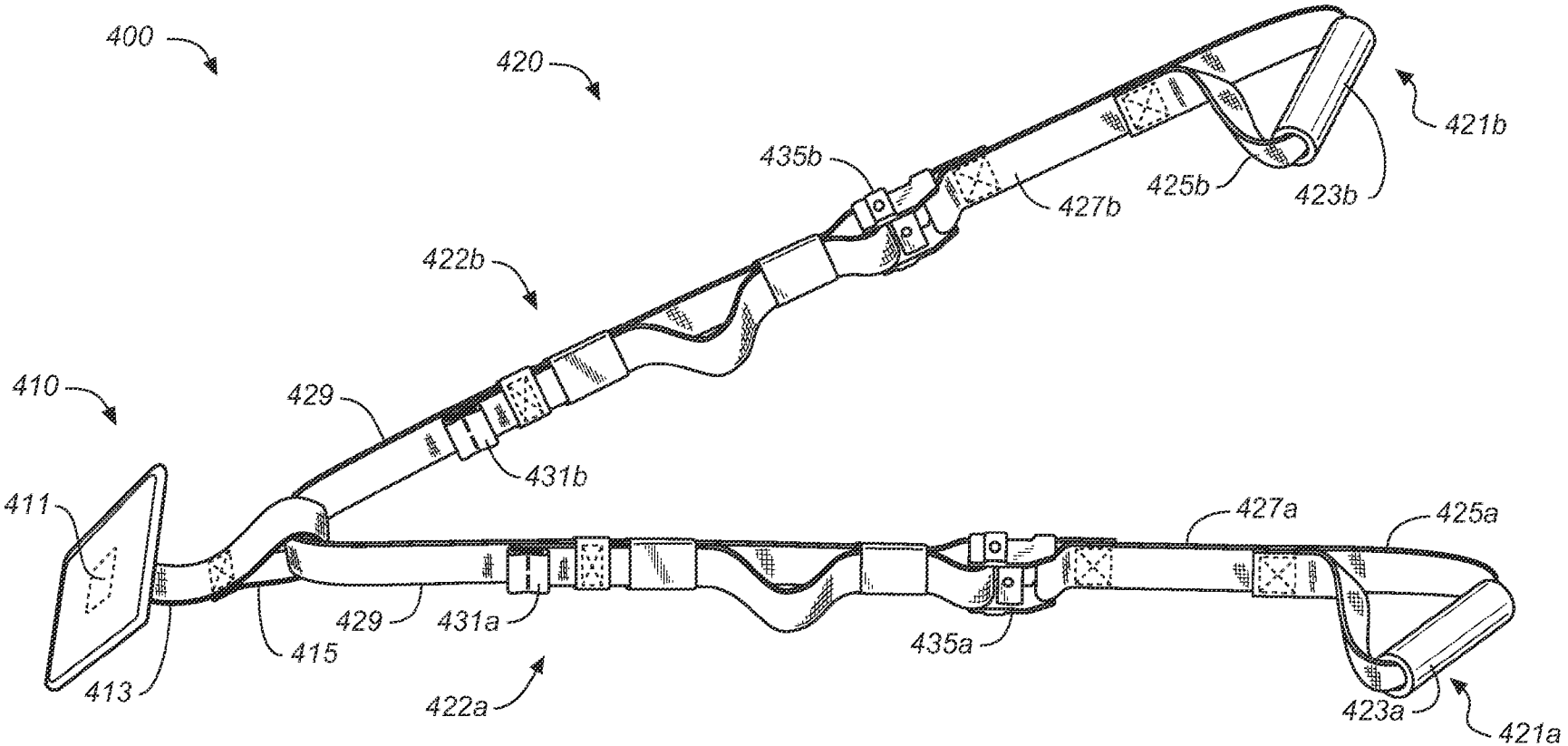
FIG. 4 is a perspective view of another embodiment of an exercise device.

Several embodiments will now be described with reference to the drawings. These embodiments are meant to be illustrative and not limiting to the scope of the claims. FIGS. 4-9 are various views of another embodiment of an exercise device 400. Referring first to FIG. 4, a perspective view of exercise device 400 is shown as including an anchor 410 and an elongated member 420. Anchor 410 includes an inelastic, flexible strap 413 having an enlarged first end 411 that is wider than the strap, and a second end that forms a loop 415. Elongated member 420 passes through loop 415, defining a pair of arms 422, indicated as arm 422*a* and 422*b*. Each arm 422 has a respective end 421, shown as end 421*a* and 421*b*, each forming a loop 425, shown as loop 425*a* and 425*b*, to support one of a pair of grips 423, shown as grip 423*a* and 423*b*. Elongated member 420 also includes a pair of lengthening devices or buckles 435, shown as buckle 435*a* and 435*b*, at either end of a central strap 429 that provides for the adjustment of the length of the elongated member. Specifically, strap 429 has a pair of ends 431, indicated as 431*a* and 431*b*, that pass through buckle 435*a* and 435*b*, respectively. As described subsequently, elongated member 420 is substantially inelastic, with the length of the elongated member being adjustable through the action of one or both of the pair of buckles 435.

Figure 5B:
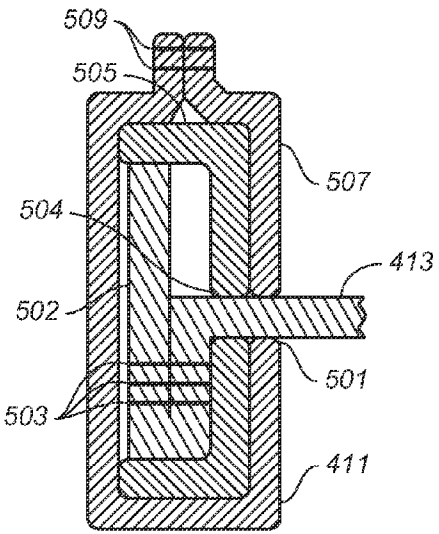
FIGS. 5A and 5B are views of the anchor portion of the exercise device of FIG. 4, where
Figure 5A:
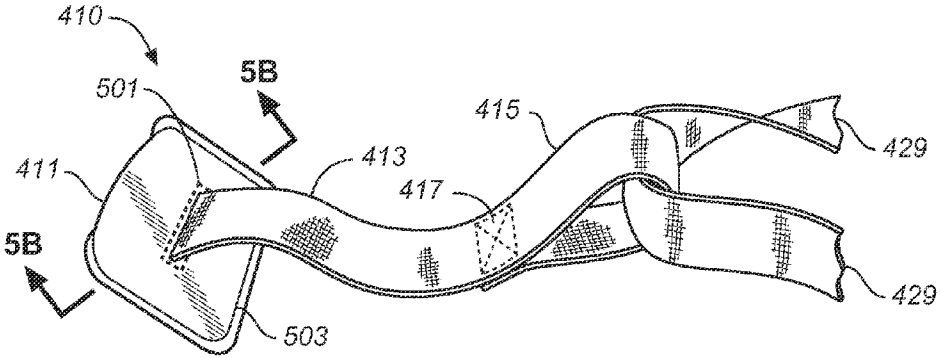

FIGS. 4, 5A and 5B present several views of anchor 410, where FIG. 5A is a perspective view of the anchor and FIG. 5B is a sectional view 5B-5B of the anchor. As noted previously, anchor 410 includes an inelastic, flexible strap 413. It is preferred that the majority of lengths of anchor 410 and elongated member 420 are formed of materials that include, but are not limited, to straps of a webbing of a natural or synthetic material having a strength sufficient to support the weight of a device user. Preferred webbings include, but are not limited to, webbings made of nylon, polypropylene or other polymeric fibers. It is understood that a single length of flexible material can alternatively comprise two or more pieces that are stitched, glued, or otherwise attached to one another. It is preferred that the length of anchor 410 is from 6 to 18 inches, or more preferably, approximately 12 inches.

Strap 413 has an enlarged first end 411 that is wider than the strap, and a second end 417 that is attached to the strap so as to form a loop 415. As shown in FIG. 5B, strap 413 has an end 502 forming the core of first end 411. Since one of the intended uses of anchor 410 is to anchor exercise device 400 between a door and jamb, it is preferable that the end 411 include materials that are soft enough to prevent damage to a wood door or door fame, yet be sturdy enough to support the weight of a user. One embodiment that is soft yet sturdy is shown in FIG. 5B. Specifically, strap end 502 is partially surrounded by a recessed enclosure 505 and a pillow 507 that covers the strap end and the enclosure. Strap end 502 can further be held within end 411 by gluing and stitching the strap end to enclosure 505 and pillow 507, and by closing the pillow with one or more stitches 509. Strap 413 passes into first end 411 through a slot 504 in enclosure 505 and through slot 501 in pillow 507. In a preferred embodiment, first end 411 is approximately 3.5" by 2.5" and is oriented approximately perpendicular to strap 413. It is also preferred that enclosure 505 is formed of a high-density, closed cell foam, and that pillow 507 is formed from a felt, and includes stitches 503. Alternatively, a second strap or piece of another material could be sewn, glued or otherwise attached to the end of strap 413 to form end 502. In another alternative embodiment, enclosure 505 can include another rigid member, such as a metal or hard plastic plate, to increase the rigidity of strap end 411.

Figure 6:
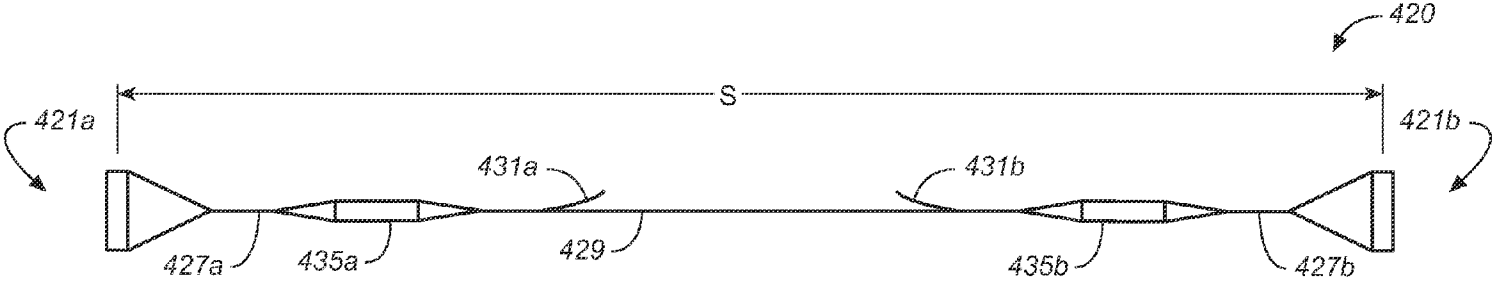
FIG. 6 is a schematic top view of the elongated member of the embodiment shown in FIG. 4 having two lengthening mechanisms and two hand grips.
Figure 7:
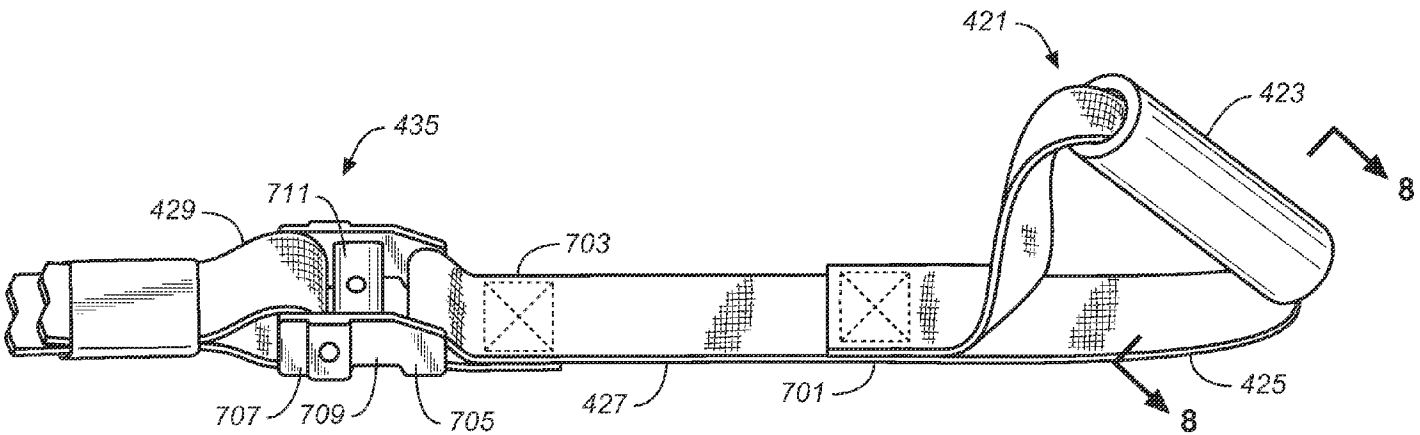
FIG. 7 is a perspective view showing details of the grip and the lengthening mechanism of the embodiment of FIG. 4.
Figure 8:
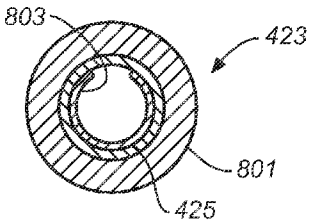
FIG. 8 is a sectional view 8-8 of FIG. 7 showing the hand grip.
Figure 9A:
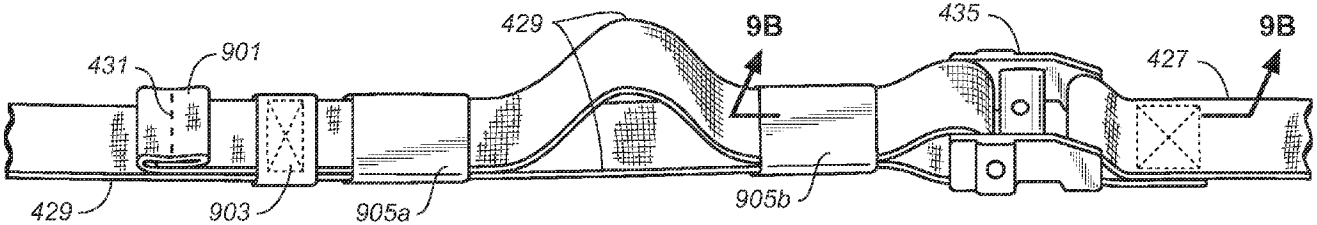
FIG. 9A is a perspective view showing details of the slack sleeves of the embodiment of FIG. 4.

Elongated member 420 is shown in greater detail in FIGS. 6-9, where FIG. 6 is a schematic top view of the elongated member, FIG. 7 is a perspective view of one of the pair of grips 421 and the corresponding one of the pair of buckles 435, FIG. 8 is a sectional view 8-8 of one of the pair of grips 421, and FIG. 9A is a perspective view showing details of one of the pair of buckles and the adjoining strap 429. As shown in FIG. 6, the elongated member 420 has length S, and includes two inelastic strap portions 427, indicated as 427*a* and 427*b*, strap 429 and the pair of buckles 435 for adjusting the length S. The portion of elongated member 420 from each end to the nearest buckle has a fixed length—that is, each of the two portions from one of the pair of ends 421 to the corresponding one of the pair of buckles 435 has a fixed length. It is preferred that the length S is adjustable over a length that allows for a wide range of exercises. Preferably, length S can be varied in length from approximately 6 feet to 12 feet. Also preferably, elongated member 420 has a width of approximately 1.5". It is also preferred that the surface finish of strap 429 and loop 415 allows the user to easily slide the elongated member 420 along anchor 410, while providing enough friction so that there can be some mis-match in forces on the two ends 421 without the elongated member sliding through the anchor while a user is exercising.

Figure 9B:
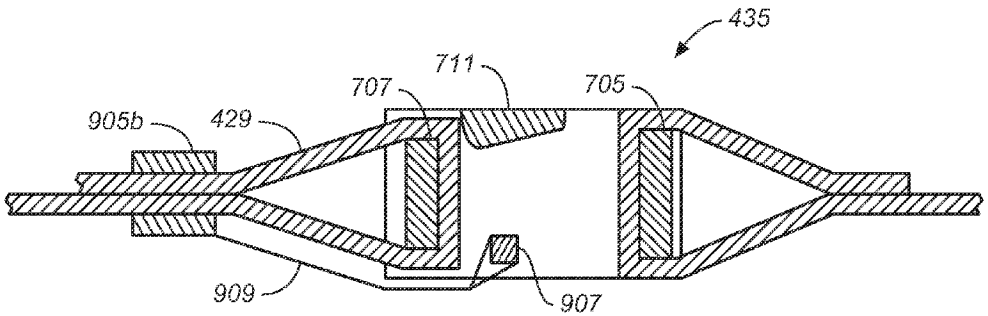
FIG. 9B is a sectional view 9B-9B of FIG. 9A showing details of the cam buckle and attachment of the slack sleeves to the cam buckle.

The details of one of the pair of ends 421, including strap 429 to grip 423, and including buckle 435 are shown in FIGS. 7, 9A and 9B. Buckle 435 is a cam buckle, the design and use of which are well known in the art. Buckle 435 is attached to strap 427, and thus the length of each of end 421 is not adjustable. Buckle 435 is also slidably accepts and grips strap 429, allowing for adjustment of the length S.

Buckle 435 has a frame 709, a first strap bar 705, a second strap bar 707, and a user movable cam 711. First strap bar 705 supports a loop of strap 427 that is preferably secured by stitches 703. Alternatively, strap 427 can be secured to bar 705 through a second member, such as another looped strap or a plastic or metal piece that loops about bar 705 and provides a location to attach strap 427. Strap 427 has an opposite end that is bound with stitches 701 to form loop 425 to secure grip 423, as described subsequently. Second strap bar 707 and cam 711 supports strap 429. It is understood that the use of stitches as described herein to fasten strap portions can also be accomplished through the use of other methods of fastening, such as glue or by melting strap portions together.

Cam 711 is spring loaded such that it normally restrains a strap 429, and that under the action of a user, such as by pushing or pulling the cam, the cam is moved to allow the strap to move. The distance between cam 711 and bar 707 is adjusted by the user and a spring within buckle 435 by pushing on cam 711, allowing strap 429 to slide between cam 711 and bar 707. Thus, the length S can be adjusted by the user actuating cam 711 of buckle 435.

Grip 423 is shown in greater detail in the sectional view of FIG. 8. Grip 423 has a generally tubular shape, with an outer cover 801 and an inner cylindrical tubular portion 803. Cover 801 has a length and outer diameter to allow a hand to easily grab grip 423, and is formed from a material that permits a user to hold it while exercising. A preferred material for cover 801 is a high-density foam. Portion 803 provides the strength of grip 423 and can be formed from a length and diameter of plastic or other rigid material to match the size of cover 801 and to provide space for a loop 425 to pass through the center of portion 803. Portion 803 is preferably formed from a rigid and light material, such as PVC tubing.

One of the pair of free ends 431 is shown in greater detail in FIG. 9A. Each end 431 is preferably folded back, and is held in place, for example by a stitch 901, to form an easily manipulated end. Elongated member 420 also includes several sleeves, shown as sleeves 903, 905*a* and 905*b* that twice surrounds strap 429 to prevent ends 431 from moving about. Specifically, sleeves 903 and 905 are placed between buckles 435, ends 431 and strap 429. Thus sleeves 903 and 905 restrain the portion of strap 429 from a buckle 435 to the corresponding end 431 from moving about as exercise device 420 is moved. As shown in FIG. 9A, sleeve 903 is affixed near end 431, while sleeves 905 can be slid along the length of strap 429. FIG. 9B is a sectional view 9B-9B of FIG. 9A showing details of the cam buckle and attachment of sleeve 905*b*. In particular, FIG. 9B shows a bar 907 that spans buckle 435 and a strap 909 that is attached both the bar and to sleeve 905*b*. Strap 909 keeps sleeve 905*b* from sliding too far down strap 429 during adjustment of the length of the exercise device. It is preferred that sleeves 905*b* are elastic so that they can easily move and hold together the portions of strap 429.

Figure 10:
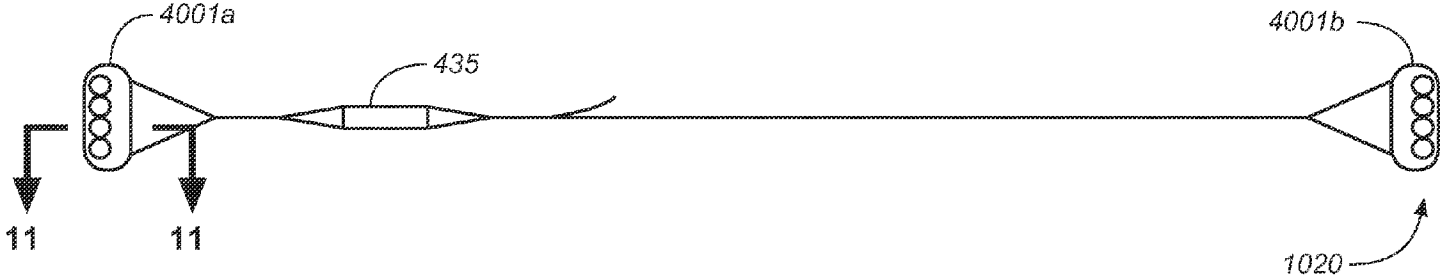
FIG. 10 is a schematic top view of an alternative elongated member embodiment having one lengthening mechanism and two finger grips.
Figure 11:
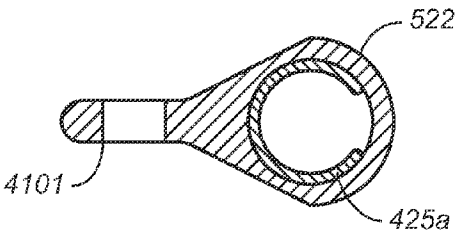
FIG. 11 is schematic sectional view 11-11 of the finger grip embodiment of FIG. 10.

While exercise device 400 has been described with respect to a particular embodiment, there are many alternative embodiments. Thus, for example, there are many embodiments that provide for an adjustable length, substantially inelastic, strap-like member that has an easily adjustable length and balance of the two sides of the strap-like member about the anchor. One alternative embodiment is shown in FIGS. 10 and 11, where FIG. 10 is a schematic top view of an alternative elongated member 1020 having one cam buckle 435 as a lengthening device, and two finger grips 4001, and FIG. 11 is a sectional view 11-11 of alternative finger grips. The use of one buckle 435 provides a lighter exercise device 400, but results in a smaller useful range of lengths for elongated member 1020. Finger grips 4001 include four holes 4101 for the user's fingers, and allows for exercise of one or more finger muscles. Modified finger grips can alternatively be provided as an "add-on" modification to elongated member 420, allowing the user to switch between finger and hand grips.

Figure 12D:
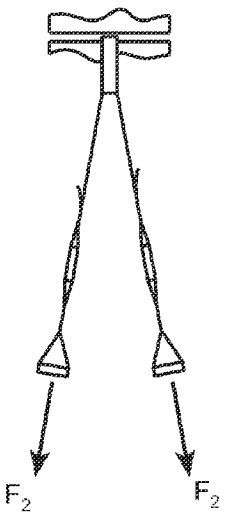
FIGS. 12A-12D are schematic drawings illustrating one embodiment of a lengthening and centering of the exercise device, where
Figure 12C:
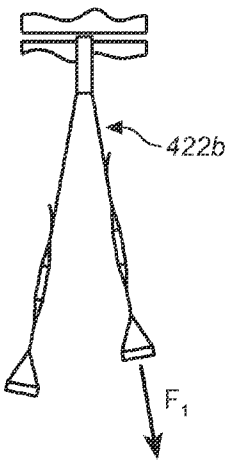
Figure 12B:
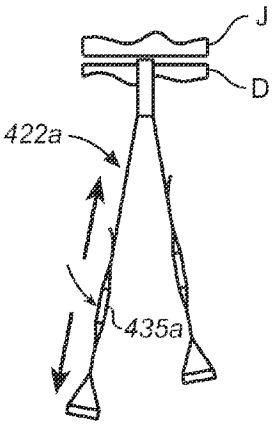
Figure 12A:
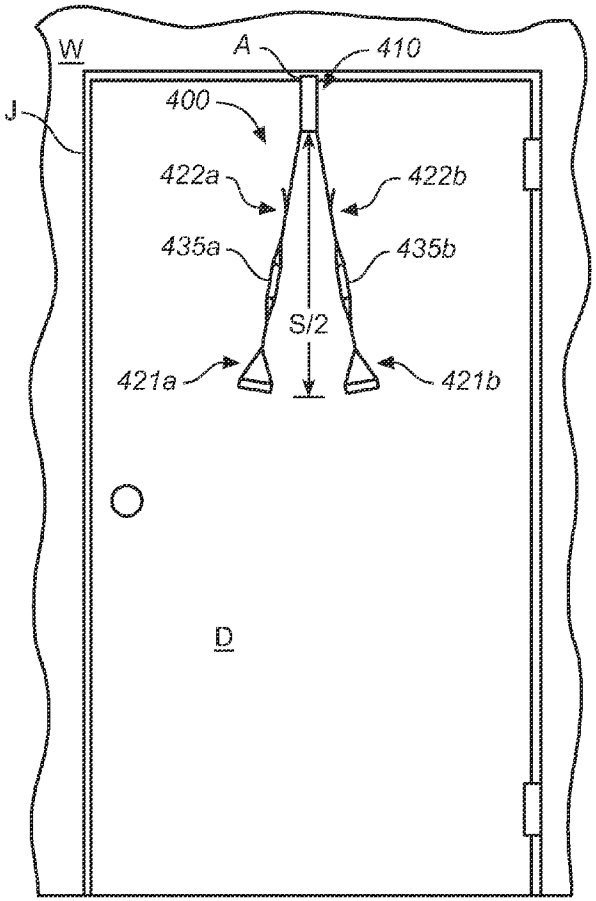

The balancing and lengthening aspects of embodiments of an exercise device are illustrated in FIGS. 12A-12D, where FIG. 12A is an initial configuration, FIG. 12B illustrates lengthening the elongated member 420, further illustrated in FIGS. 12B' and 12B", FIG. 12C shows the application of force to the shorter leg of the elongated member, and FIG. 12D shows the application of force to the grips during an exercise. For illustrative purposes, FIG. 12A is assumed to be an initial configuration of an anchored device, and it is assumed that the user wishes to increase the length S while keeping the pair of arms 422 the same length (approximately one half of S). First, the user actuates one or both buckles 435. FIG. 12B schematically shows the result of actuating buckle 435*a* and elongating leg 422*a* as indicated by the arrows on that figure. FIG. 12B' shows the user U pushing cam 711 and grabbing end 431, and FIG. 12B" shows the user pulling end 431 away from the cam, as indicated by the arrow, to shorten the device.

The user then preferentially pulls on the shorter leg 422*b* as indicated by force vector F1 of FIG. 12C. With both of the pair of legs 422 having approximately the same, longer length the user can then exercise, as indicated in FIG. 12D, by applying equal forces F2 to each handle grip. In practice, it is not necessary for the two forces of FIG. 12D to be equal, as the application of force to legs 422 away from anchor 410 increases the friction between elongated member 420 and the anchor, allowing the lengths to not change, even under some mis-match of applied forces. Alternatively, exercise device can be adjusted to provide shorter legs 422 by pulling on end 431 to shorten the length S.

Figure 13C:
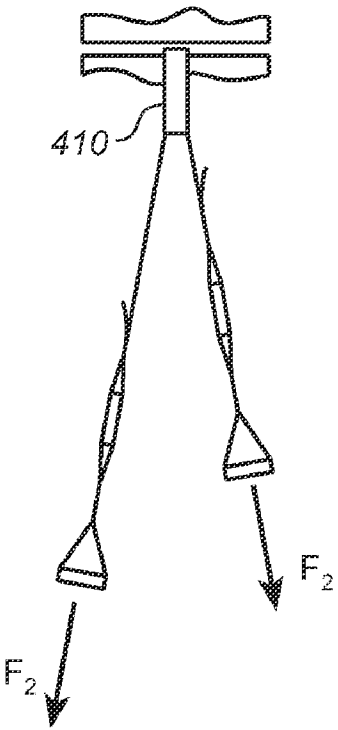
FIGS. 13A-13C are schematic drawings illustrating the one embodiment of a lengthening and adjusting of the exercise device having differing arm lengths, where
Figure 13B:
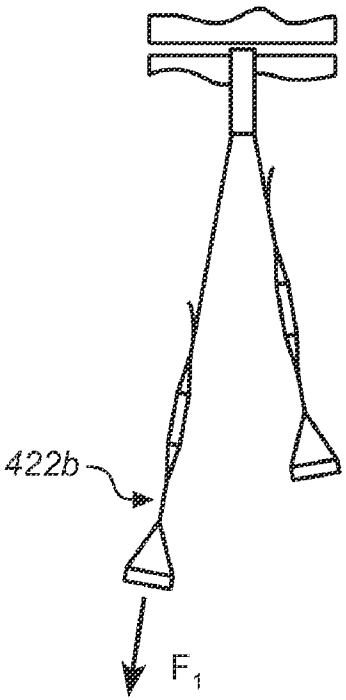
Figure 13A:
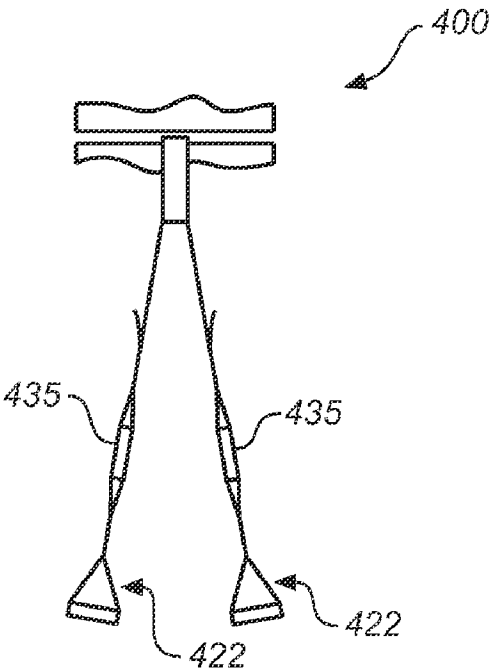

In addition to being equally balanced between the two arms, it is possible to use the inventive device to provide differing arm lengths for exercising. FIGS. 13A-13C illustrate the lengthening and adjusting of exercise device 400 having differing lengths of arms 422, where FIG. 13A is an initial configuration, FIG. 13B shows the application of force to one of the pair of arms 422, and FIG. 13C shows the application of force to the grips during an exercise. For illustrate purposes, FIG. 13A is assumed to be an initial configuration of an anchored device, and it assumed that the user wishes to adjust the length of arms 422 to different lengths. First, the user preferentially pulls on the shorter leg 422*b* as indicated by force vector F1 of FIG. 13B. The user can then exercise, as indicated by the equal forces F2 of FIG. 13C. In practice, it is not necessary for the two forces of FIG. 13C to be equal, since as illustrated in FIG. 12, as the application of force to legs 422 away from anchor 410 increases the friction between elongated member 420 and the anchor also increases. This limits the possibility that the arm lengths will change, even under some mis-match of applied forces. The adjustment of arms 422 to different lengths can be combined with the lengthening or shortening of the length S by actuating one or both of buckles 435.

Various mechanisms for providing a fixed anchor point are within the scope of the present invention. Thus, for example and without limitation, embodiments of an exercise device can be anchored in a door, about a pole, railing or stanchion, from a hook installed in a wall, or can be permanently affixed to a wall or exercise structure, for example. FIG. 14A is an alternate embodiment anchor 1410 that can be used for attaching the exercise device to a pole or railing, and FIG. 14B is an embodiment of an exercise device anchored to a pole using the alternative anchoring embodiment of FIG. 14A.

FIG. 14A shows alternative embodiment anchor 1410 which includes an adjustable loop 1419 and an anchor loop 1415. As described subsequently, anchor 1410 is an alternative anchor, and can, for example, presents anchor loop 1415 for accepting strap 429 of elongate member 420 to form an exercise 1400. Adjustable loop 1419 is formed from a flexible strap 1411 and a cam buckle 1412 as follows. Cam buckle 1412 can be, for example, cam buckle 435 shown in detail in FIG. 9B. Flexible strap 1411 has a free, first end 1414 that is threaded through the cam portion of cam buckle 1412, for example by threading the strap between the second strap bar 707 and movable cam 711 of cam buckle 435. Flexible strap also has a second end 1418 that is attached to cam buckle 1412, for example, by looping the second end about first strap bar 705 of cam buckle 435 and providing a stitching 1416 through a double thickness of strap 1411. Strap 1411 thus threaded through buckle 1412 has forms an adjustable loop 1419 that can be increased or decreased in size by actuating cam buckle 1412 to release strap 1411, moving the strap through the cam buckle, and releasing the cam. End 1414 is held against strap 1411 by a slack sleeve 1413. An anchor loop 1415 is attached to strap 1411 by a stitching 1417.

It is preferred that the majority of lengths of anchor 1410 are formed of materials that include, but are not limited, to straps of a webbing of a natural or synthetic material having a strength sufficient to support the weight of a device user. Preferred webbings include, but are not limited to, webbings made of nylon, polypropylene or other polymeric fibers. It is understood that alternative embodiments of a single length of flexible material include, but are not limited to, two or more pieces that are stitched, glued, or otherwise attached to one another.

Figure 14B:
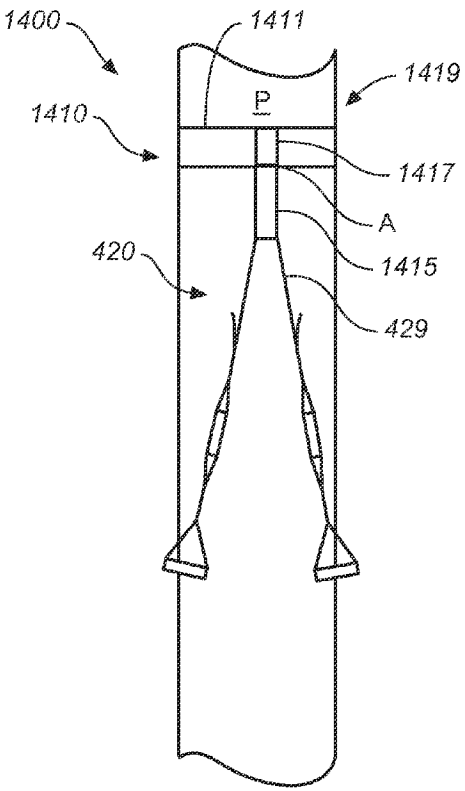
FIG. 14B is a exercise device anchored to a pole using the alternative anchoring embodiment of FIG. 14A.
Figure 14A:
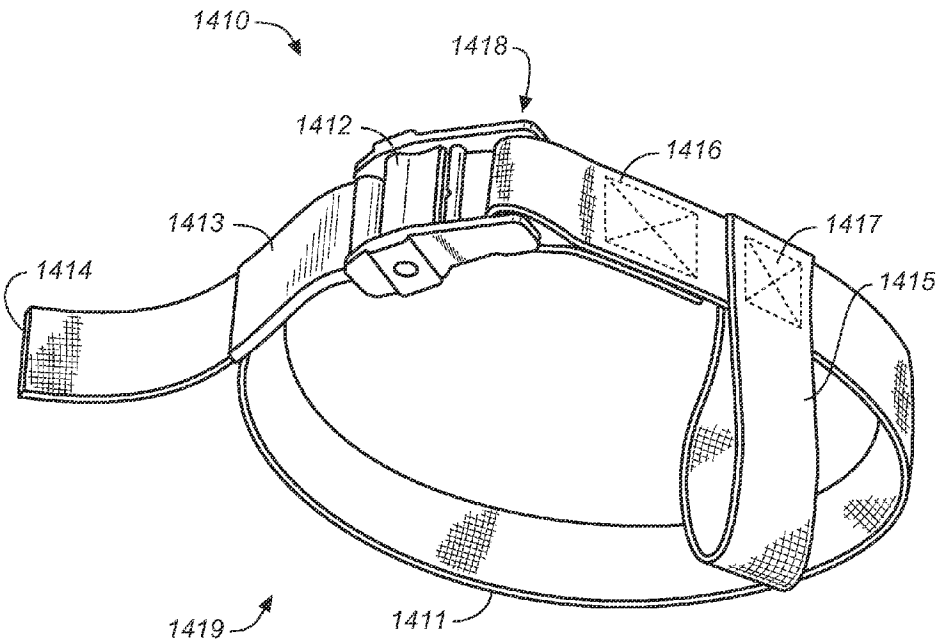
FIG. 14A is an alternate embodiment anchor that can be used for attaching the exercise device to a pole or railing.

FIG. 14B shows exercise device 1400 formed from anchor 1410 and elongated member 420. Adjustable loop 1413 of anchor 1410 is tightened about a pole P, for example, by placing the adjustable loop over the top of the pole and tightened using cam buckle 1412. Alternatively, strap 1411 can unthreaded from cam buckle 1412, wrapped about pole P, and then threaded through the cam buckle and tightened. In either case, end 1414 is the pulled through cam buckle 1412 and adjustable loop 1419 is tightened about pole P with sufficient force to allow exercise device 1400 to support a user's weight.

In addition to being attached to a pole, anchor 1410 can be tensioned to support exercise device 1400 about a railing, post, or other member. Alternately, the anchor can be attached to a carbineer that is fixed to a wall or other structure.

Figure 23:
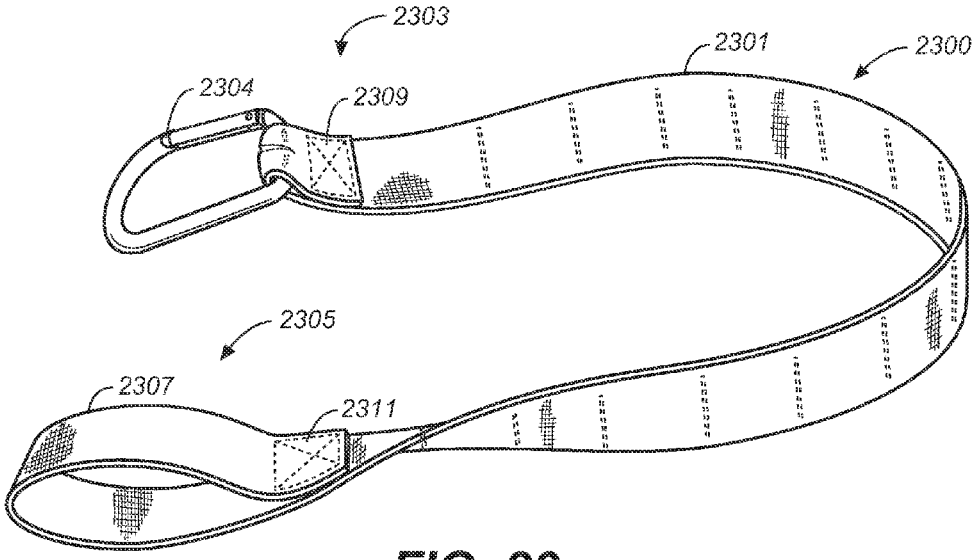
FIG. 23 shows another alternative embodiment anchor.
Figure 24:
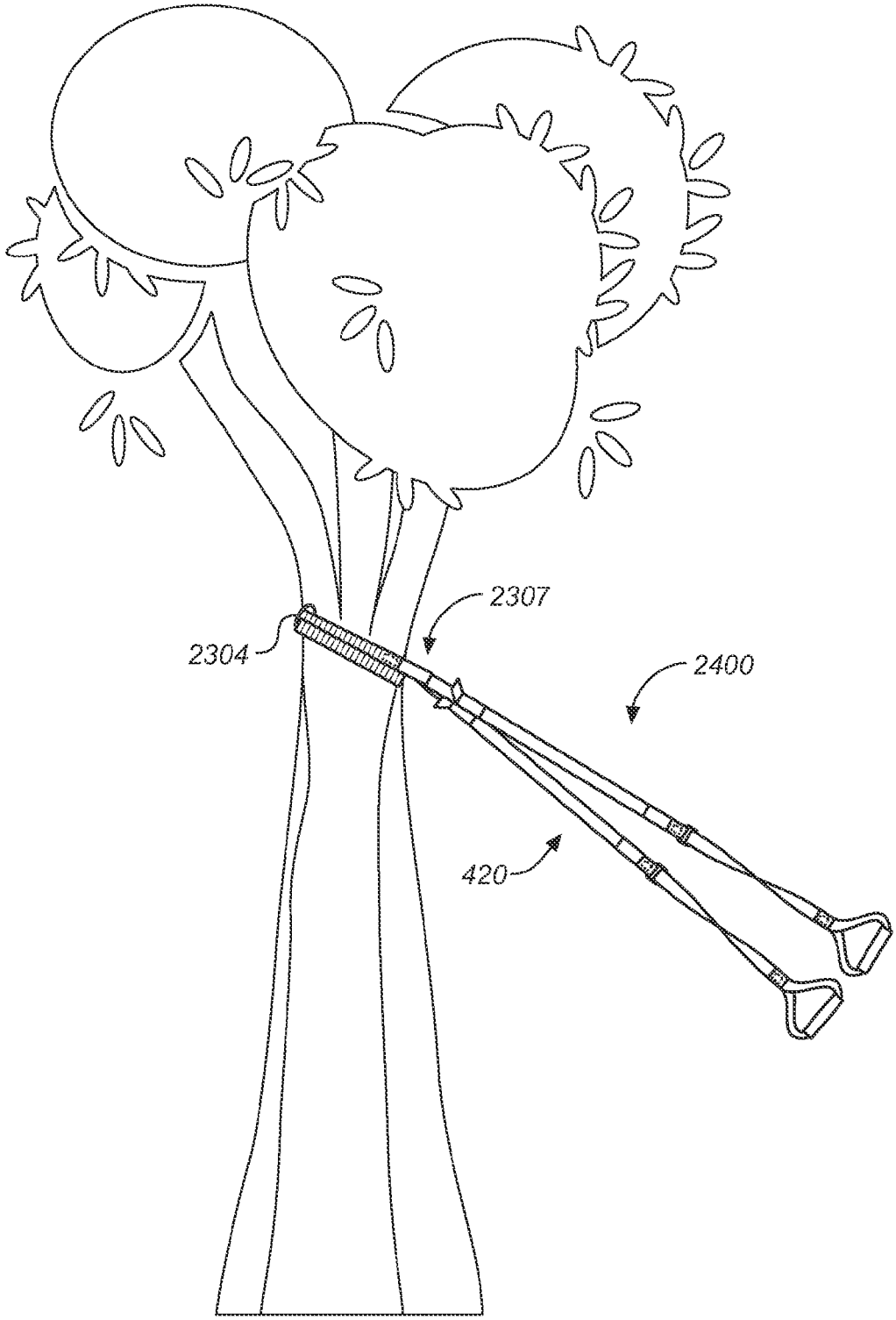
FIG. 24 illustrates the use of the anchor of FIG. 23 to anchor an exercise device to a tree.

FIG. 23 shows an anchor 2300 including a flexible strap 2301 with a first end 2305 having a loop 2307 held in place with stitching 2311 and a second end 2303 having a carabineer 2304 held in place by stitching 2309, and FIG. 24 illustrates the use of anchor 2300 to anchor the elongated member 420 of the exercise device to a tree. It is preferred that the majority of lengths of strap 2301 are formed of materials that include, but are not limited, to straps of a webbing of a natural or synthetic material having a strength sufficient to support the weight of a device user. Preferred webbings include, but are not limited to, webbings made of nylon, polypropylene or other polymeric fibers. FIG. 24 shows an exercise device 2400 formed from anchor 2300 and elongated member 420. Strap 2103 is be wrapped about a tree with carabineer 2304 accepting the strap. Loop 2307 accepts strap 429, allowing the user to exercise against a tree or other object small enough for strap 2103 to be wrapped about.

Figure 25:
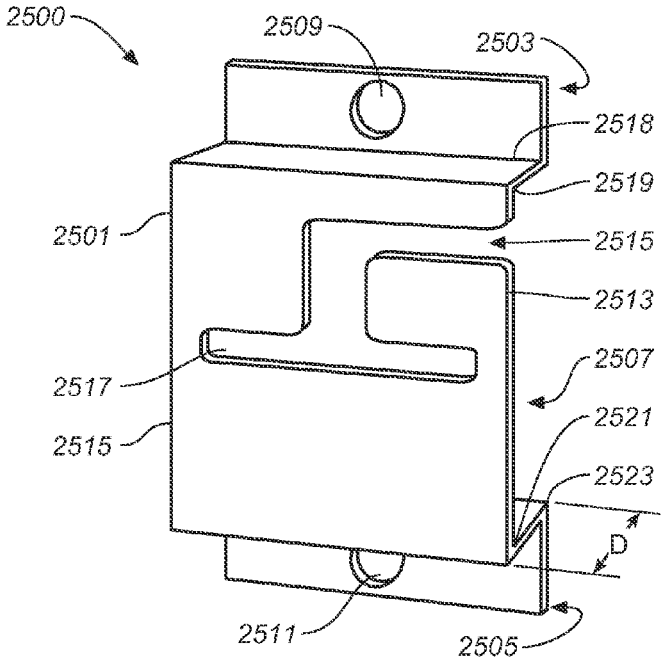
FIGS. 25 and 26 shows an embodiment of a bracket for securing an exercise device by an enlarged first end of an anchor, where
Figure 26:
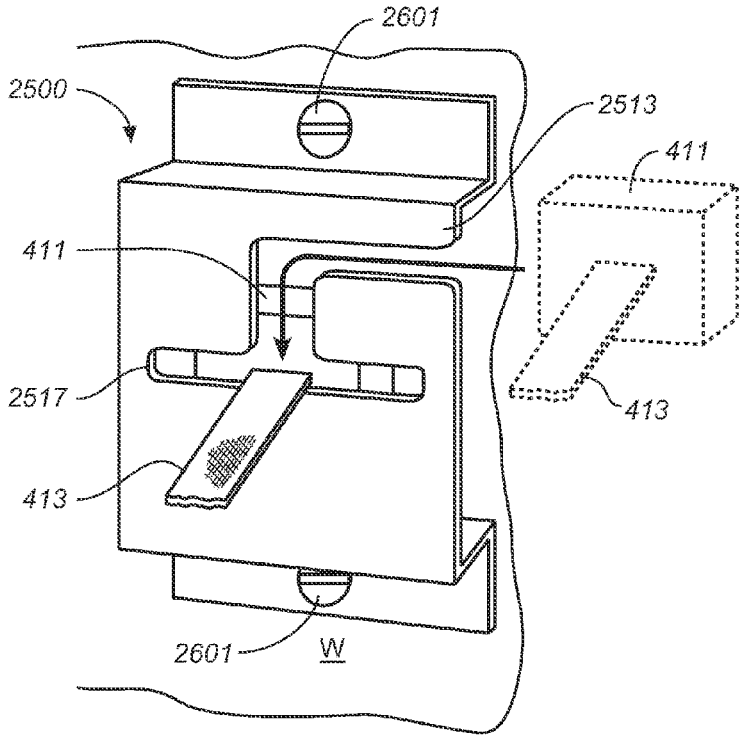

FIGS. 25 and 26 shows a bracket 2500 for securing exercise device 400 by enlarged first end 411 of anchor 410, where FIG. 25 is a perspective front view of the bracket, and FIG. 26 illustrates the use of the bracket to anchor the exercise device. Bracket 2500 has a first flange 2503 with a mounting hole 2509 and a second flange 2505 with a mounting hole 2511 and a face 2507 that extends from the first flange to the second flange and includes a slot 2515 that extends into the face a face edge 2513 and includes a central slot 2517. In a preferred embodiment, bracket 2500 is formed from a single sheet 2501 of sheet metal, for example that has crease 2518 in flange 2503, crease 2523 in flange 2505, and creases 2519 and 2521 between face 2507 and flanges 2503 and 2505, respectively. The preferred thickness of sheet 2501 is from 0.05 to 0.10 inches, or more preferably approximately 0.0625 inches, and creases 2518, 2519, 2521, and 2523 are placed to such that face 2507 is parallel to and separated from flanges 2503 and 2505 by a distance D of from approximately 1 to 2 inches, or more preferably approximately 1.5 inches. Mounting holes 2509 and 2511 are preferably between approximately ¼ inch and approximately ½ inch in diameter, and more preferably approximately ⅜ inch in diameter.

FIG. 26 illustrates the use of bracket 2500. Bracket 2500 is mounted to a wall W, and held in place by a pair of screws 2601 through mounting holes 2509 and 2511. A portion of anchor 410 is shown in phantom on the right side of FIG. 26, specifically enlarged portion 411 and flexible strap 413. Anchor 410 is placed in bracket 2500 as indicated by the arrow. Specifically, strap 413 is slid through the slot 2515 in face edge 2513, with enlarged portion between bracket 2500 and wall W and into central slot 2517. Slot 2515 is sized to be large enough to allow strap 413 to slide through the slot but not so large as to allow enlarged portion 411 to pass through the slot. The use of bracket 2500 allows for exercise device 400, which was previously shown as being mountable in a doorjamb, to be mounted against any wall to which the bracket can be mounted.

The inventive exercise device allows for a wide range of exercises. Examples of the many exercises that are possible are presented in TABLE 1 for the inventive device placed over the top of a door. FIGS. 3 and 15 illustrate three of the many exercise positions. In each of these positions the user has selected a length for exercise device 100 or 400, adjusted as explained with reference to FIG. 12 or 13, has positioned himself on the ground a desired horizontal distance X from anchor point A with a portion of his weight being supported by the exercise device. With his weight so supported, as shown in FIGS. 3 and 15, he moves his body in directions appropriate to the type of exercise to be performed, for example by moving his body toward or away from the wall or ground, by bending his arms or legs while supporting his weight by the exercise device, or performing other movements that exercise his muscles.

Figure 15B:
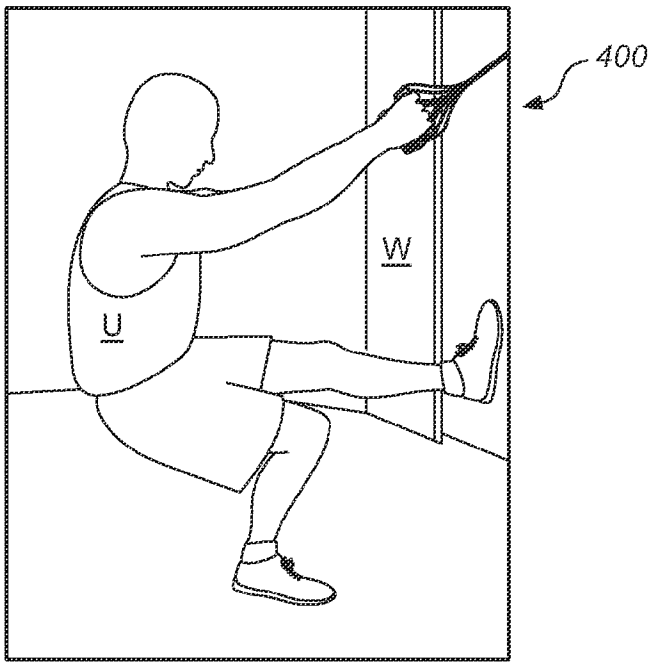
FIGS. 15A-15I illustrate poses of a user using an embodiment of an exercise device to perform exercises, where
Figure 15A:
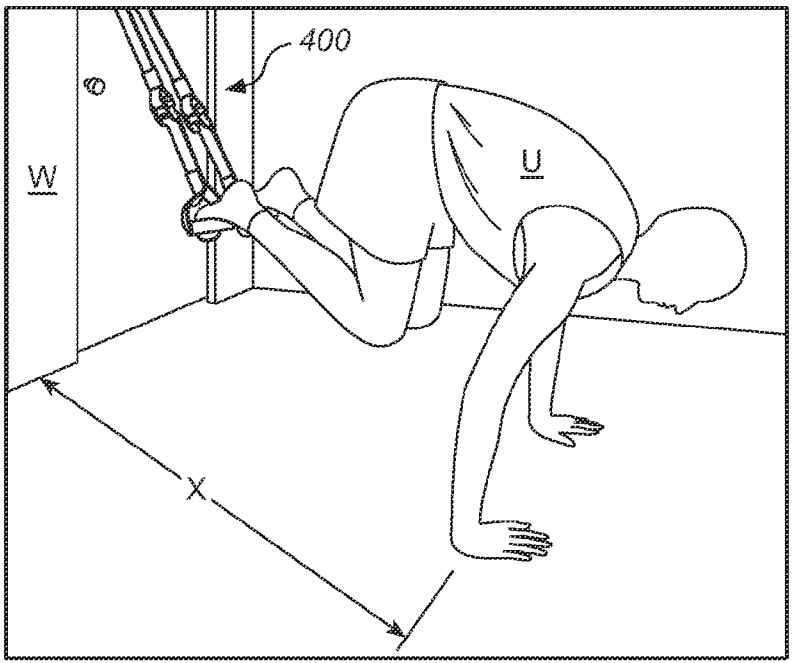
Figure 15E:
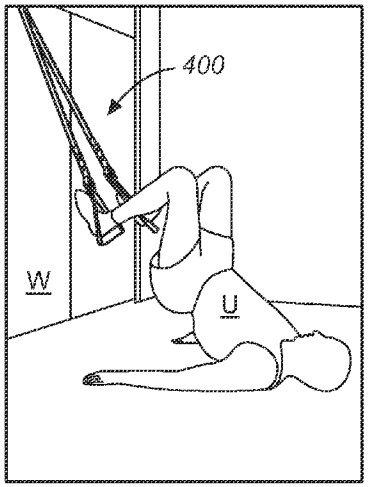
Figure 15F:
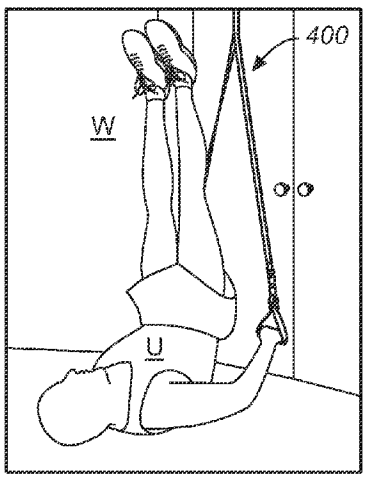
Figure 15C:
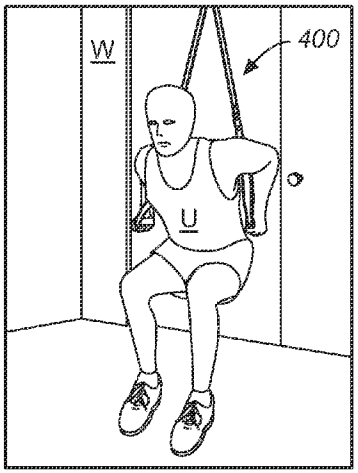
Figure 15D:
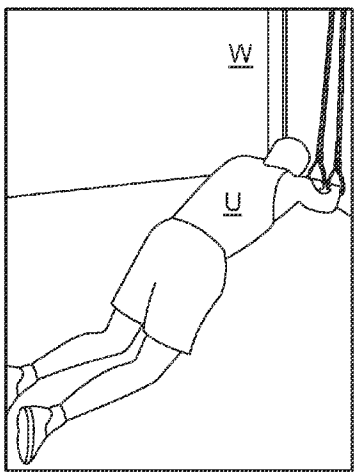
Figure 15I:
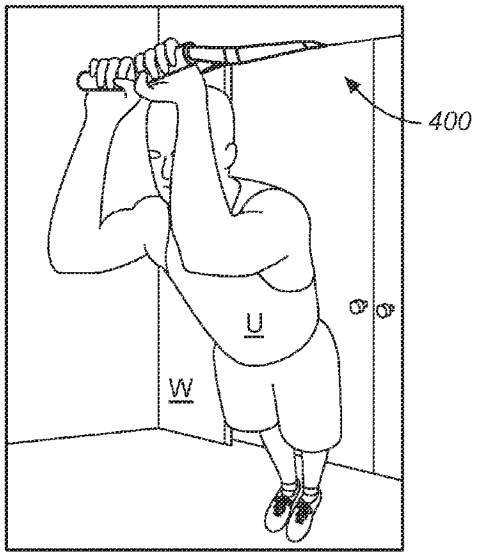
Figure 15G:
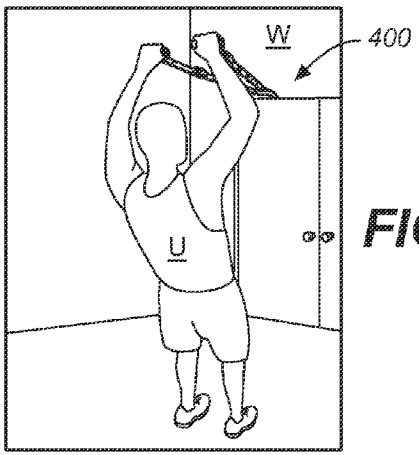
Figure 15H:
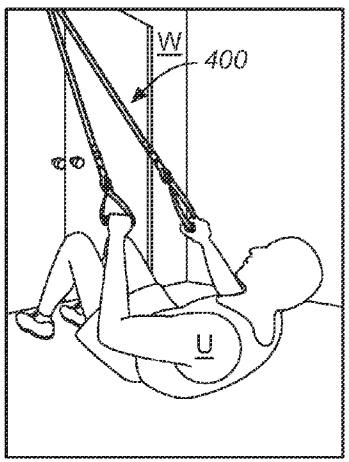

Specifically illustrated in FIGS. 3 and 15 are single poses of a user U performing a variety of exercises including a high row exercise (FIG. 3), a reverse combination crunch (FIG. 15A), a single leg L-squat (FIG. 15B), a gymnast dip (FIG. 15C), a kneeling combination crunch (FIG. 15D), a lying leg curl (FIG. 15E), a hip lift (FIG. 15F), a front shoulder raise (FIG. 15G ), a crunch (FIG. 15H), and a triceps extension (FIG. 15I). It is apparent from FIGS. 3 and 15 that many different types of exercises are possible with the inventive exercise device according to the length of the device, the positioning of the body, and how the handles are gripped.

TABLE 1

Several Basic, Intermediate, and Advanced Over the Door Anchor Exercises.

| Basic Exercises | Intermediate | Advanced |
|---|---|---|
| Pull functions | Pull functions | Pull/lateral functions |
| Low row | One-arm low row | Lateral raise |
| High row | One-arm high row | Front shoulder raise |
| Pull-up | One-arm pull-up | Reverse-grip curl |
| High curl | One-arm high curl | Combination row/kickback |
| Low curl | One-arm low curl | Internal rotator cuff |
| Back fly | Lower chest/lat crunch | External rotator cuff |
| Wrist curl | Reverse-grip wrist curl | 2-Way forearm flexors |
| Core Strength | Core Strength | Core Strength |
| Crunch | Kneeling combination crunch | Standing combination crunch |
| Reverse single leg raise | Reverse leg raise | Reverse leg raise w/hip lift |
| Oblique crunch | V-sit-up | Reverse oblique raise |
| Reverse crunch | Hip lift | V-balance |
| Bicycle | Reverse bicycle | Reverse combination crunch |
| Back Bridge | | |
| Legs | Legs | Legs |
| Squat | Lying hamstring pedal | Lying hamstring curl |
| Hip hinge | Tip-toe squat | Single-leg hip hinge |
| Squat lunge | Step-back lunge | Single leg L-squat |
| Sumo squat | Single leg squat | Diagonal Step-back lunge |
| Side-to-side lunge | Single calf raise | Crossover off-balance squat |
| Calf raise | Jumping Ski PT | |
| Push functions | Push functions | Push functions |
| Standard press | One-arm incline press | Triceps kickback |
| Chest fly | Low chest press (outside grip) | One-arm concentration fly |

TABLE 1-continued

Several Basic, Intermediate, and Advanced Over the Door Anchor Exercises.

| Basic Exercises | Intermediate | Advanced |
|---|---|---|
| Shoulder press | Reverse Push-up | Reverse crunch/push-up combo |
| Overhead triceps extension | One-arm triceps extension | One-arm shoulder press |
| Lat-Pullovers | | Gymnast dip |

Figure 16B:
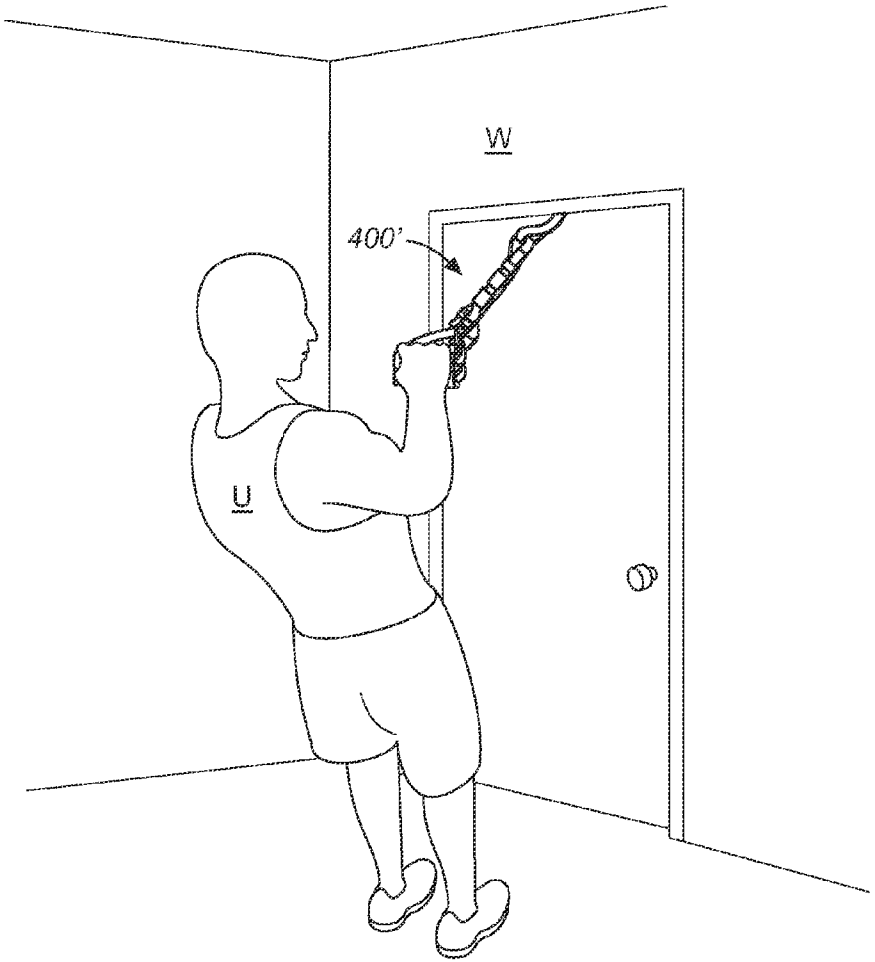
FIGS. 16A and 16B illustrate an embodiment of the exercise device for doing one handed exercises, where
Figure 16A:
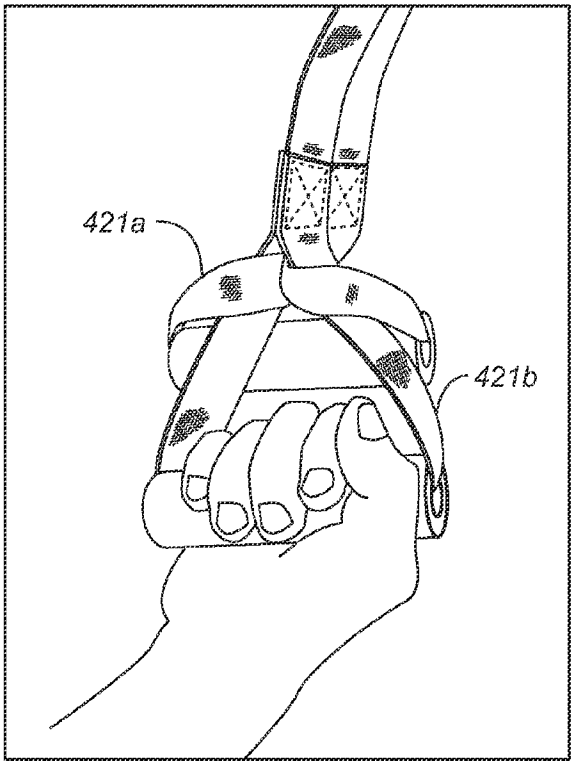

In addition, the inventive device can be used to perform one handed exercises as illustrated in FIGS. 16A and 16B. Specifically, FIG. 16A shows an exercise device 400' having interlocking the ends 421*a* and 421*b* for one handed exercises, and FIG. 16B illustrates the use of the exercise device 400' in performing a one arm high row exercise.

Alternative Exercise Device Grips

The utility of exercise devices is greatly extended by providing a number of grips for the device, specifically by providing alternative grip devices which may be removable from the device (that is, are an "add-on," or "accessory" to the exercise device), or which form part of the device that is not removable (that is are "integral" to the exercise device).

In general, several embodiments of grips described herein are attached to, or are attachable to, one of the pair of grips that are part of an exercise device, including but not limited to grips 123 of exercise device 100, and provide an accessory grip whereby the user can exercise by applying forces to various part of the body, including the neck, all or part of the hand, arms, legs, toes, or the heel. Grip accessories allow the user to grip, such as by squeezing with sufficient force to support her weight, and include devices that can hold the user within a loop or hook as the user pulls on the exercise device. In this context, a "grippable" portion refers to the ability to either wrap a body part around and squeeze a that portion of the grip accessory, or place a portion of the body through a loop or hook of the grip accessory so that the user can pull against the exercise device and keep the body part within the grip accessory.

The user may choose to exercise with the pair of grips having the same or different accessories, or without a grip accessory. In addition, several embodiments of the exercise device include a grip attachment portion to removably attach the grip of an exercise device, such as exercise device 100 or any exercise device having two grips, and a portion that is grippable by the hand, foot, fingers, or other parts of the body. The use of grip accessories allow a user to build additional strength in the hand or fingers by providing for different types of hand or finger gripping, and allows for additional exercises to be performed, as with the foot grip accessory. In addition, the pair of grips can be coupled, as discussed in reference to FIGS. 16A and 16B, allowing a user to exercises using one grip accessory.

Figure 17A:
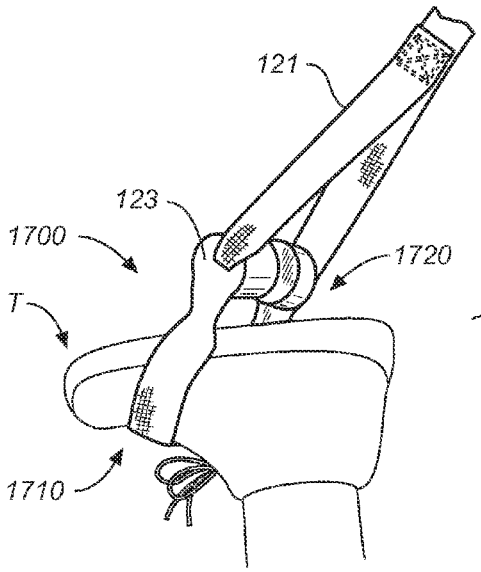
FIGS. 17A and 17B show an embodiment of a foot grip accessory as attached to a grip of an exercise device, where
Figure 17B:
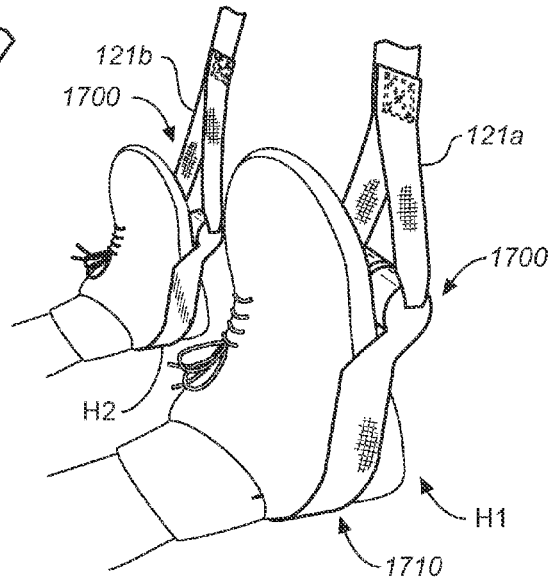

One example of a grip accessory is foot grip accessory 1700, which is illustrated in FIGS. 17A-17B as being attached to grips 123 of exercise device 100. Specifically, FIG. 17A illustrates foot grip accessory 1700 attached to exercise device 100 and gripped by toes T, and FIG. 17B illustrates a pair of foot grip accessories, one on each of the pair of grips 123, and each grasped by one of the user's heel H1 and H2. Each foot grip accessory 1700 has a flexible loop 1710 and a grip attachment portion 1720. It is preferred that the portion of loop 1710 that extends from grip 123 is approximately 12 inches long to provide enough room for either a user's heel or toe fit through the loop. With foot grip accessory 1700 so secured, the toes (FIG. 17A) or heel (FIG. 17B) can be placed through loop 1710, and a force can be exerted by the foot against exercise device 100.

It is preferred that the majority of foot grip accessory 1700 is formed of materials that include, but are not limited, to straps of a webbing of a natural or synthetic material having a strength sufficient to support the weight of a device user. Preferred webbings include, but are not limited to, polymeric fiber webbings made of, for example, nylon or polypropylene or some other polymeric fiber. It is understood that a single length of flexible material can alternatively comprise two or more pieces that are stitched, glued, or otherwise attached to one another.

In one embodiment, each of the pair of grips 123 is provided with one foot grip accessory 1700, facilitating exercises including, but not limited, to those illustrated in FIGS. 15A and E.

Figure 18A:
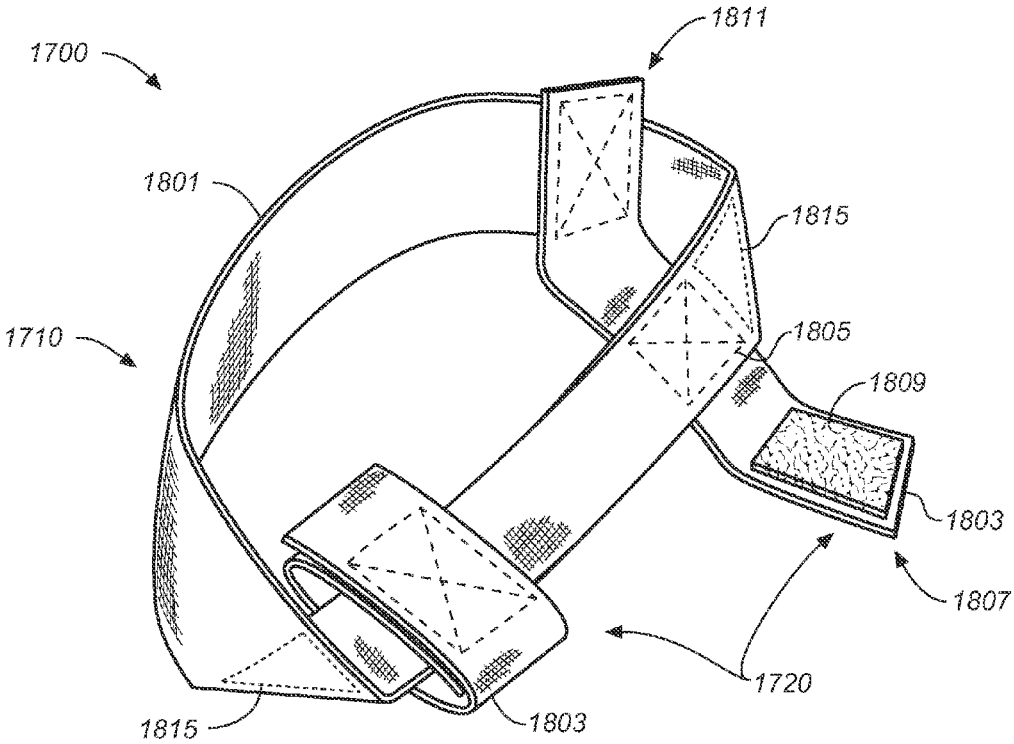
FIGS. 18A, 18B, 18C and 18D show a first embodiment of the foot grip accessory of FIGS. 17A-B, where
Figure 18B:
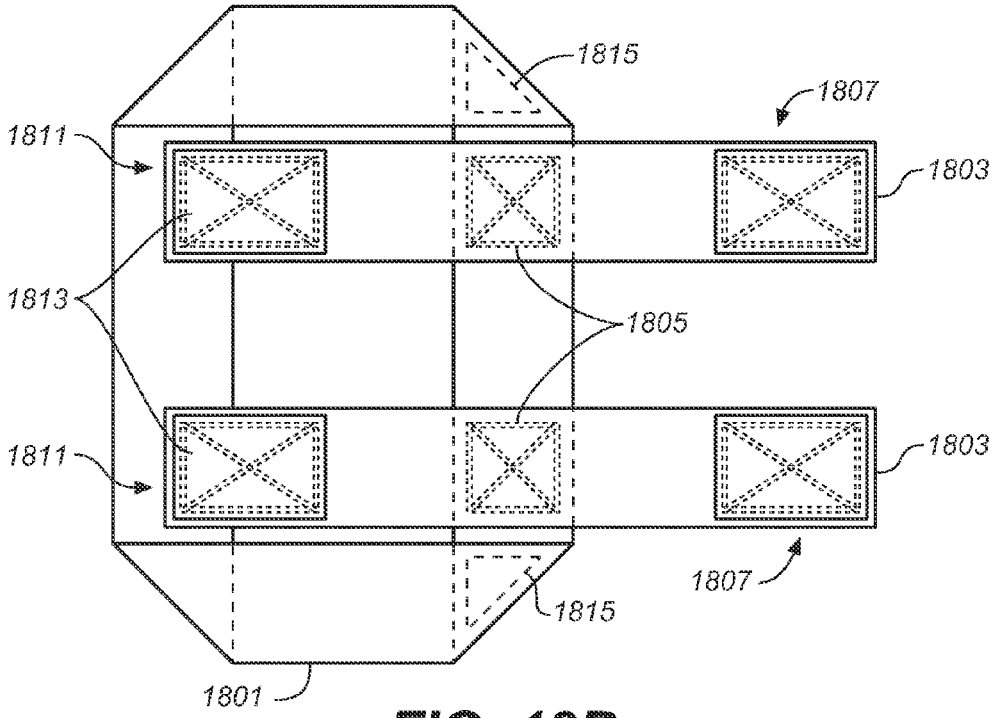
Figure 18C:
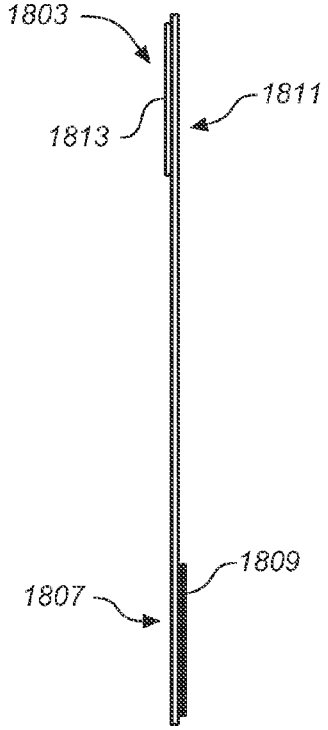
Figure 18D:
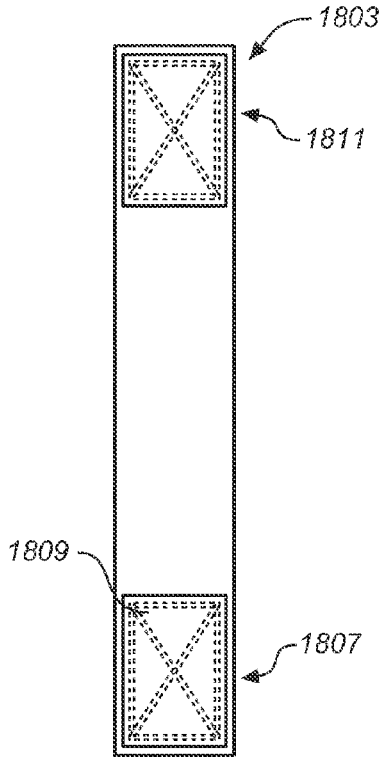

In a first embodiment foot grip accessory 1700, flexible loop 1710 is removably attachable, as discussed subsequently, to one of the pair of grips 123. A specific embodiment of foot grip accessory 1700 is illustrated in FIGS. 18A-D, where FIG. 18A is a perspective view of the foot grip accessory, FIG. 18B is a bottom view of the foot grip accessory, FIG. 18C is a side view of part of one of the grip attachment portions, and FIG. 18D is a top view of part of one of the grip accessory attachment portions. As shown in FIGS. 18A and 18B, foot grip 1700 is formed from three straps: a loop strap 1801 and two attachment straps 1803. With the three straps attached, as described subsequently, loop strap 1801 forms loop 1710 and the two attachment straps 1803 forms the grip attachment portion 1720.

Loop strap 1801 is formed from a length of strapping having ends that are joined to form a loop. Loop strap 1801 is preferably polymeric fiber webbing 20 inches long and 1.5 inches wide. In the preferred embodiment, the loop includes two triangular shaped double stitched portions 1815, one of which joins the two ends of loop strap 1801. Each of the two grip attachment straps 1803 is formed from a length of strapping having a first end 1807 with a first fastening surface 1809 and a second end 1811 with a second fastening surface 1813. Attachment straps 1803 are preferably polymeric fiber webbing having a length of 7.5 inches and a width of 1.5 inches. Fastening surfaces 1809 and 1811 are preferably attached to loop strap 1801 by double stitching 1817, and grip attachment straps 1803 are preferably joined midway between ends 1807 and 1811 to the loop strap by double stitching 1805.

Each attachment strap 1803 includes fastening surfaces 1809 and 1813 are on opposite sides of the strap. It is preferred that fastening surfaces 1809 and 1813 are matching surfaces, such as matching hook and loop surfaces of a hook and loop fastening system, such as VELCRO® brand hook and loop fasteners. In a preferred embodiment, fastening surfaces 1809 and 1813 are each approximately 2 inches by 1.25 inches.

Foot grip accessory 1700 is removably attachable and is used as follows. Grip attachment portion 1720 of foot grip accessory 1700 is removably attachable to one of the pair of grips 123, by wrapping the length of each strap 1703 about grip 123*a* and contacting fastening surfaces 1809 and 1813 on each strap 1803. Stitching 1815 allows loop 1710 to open without twisting and provides a secure strap for securing the foot.

Figure 27:
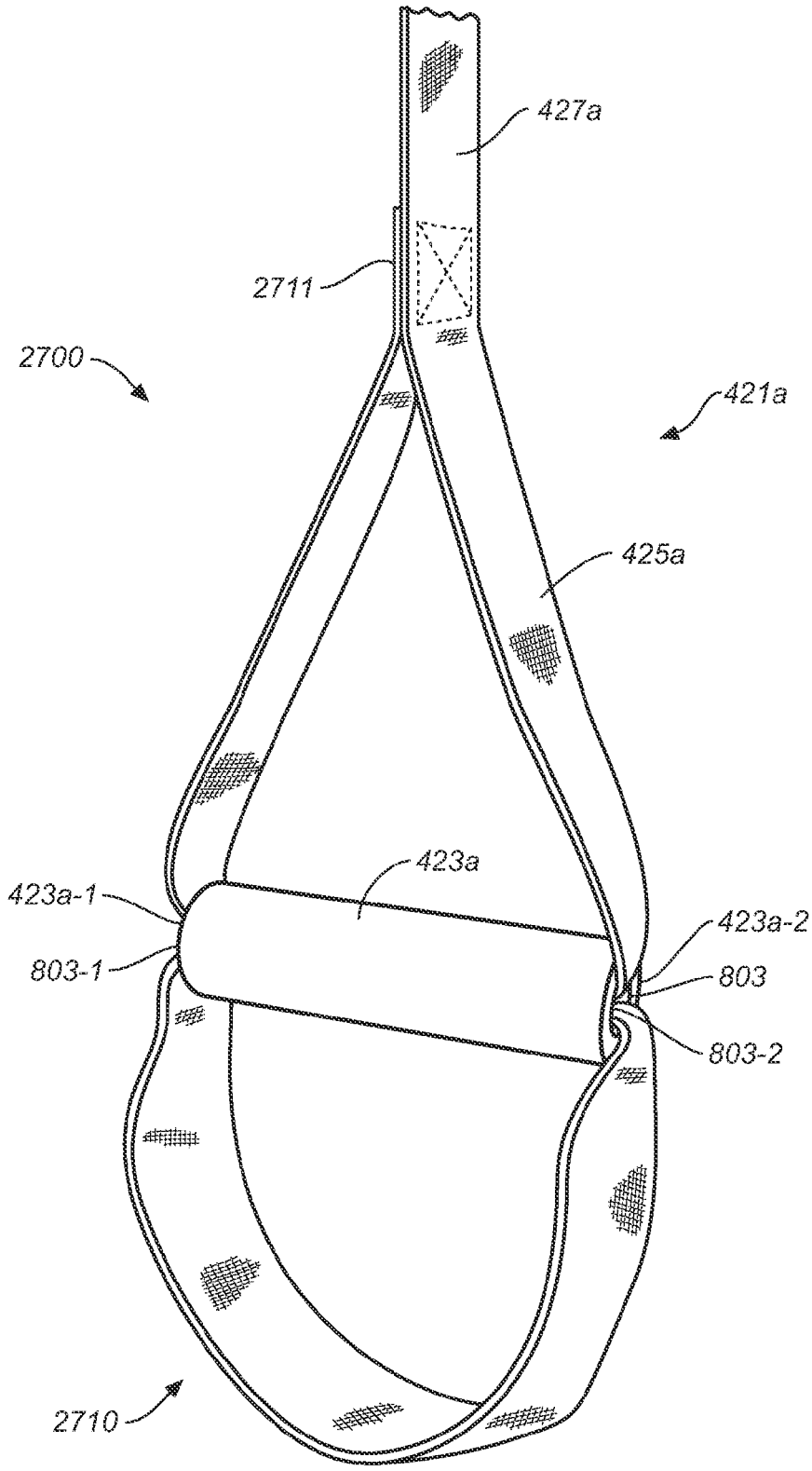
FIG. 27 is a perspective view of a first embodiment combination grip.

FIG. 27 is a perspective view of a grip which may be used as either a hand grip or a foot grip, and which is referred to herein without limitation as a "combination" grip 2700. Grip 2700 may be generally similar to the grips or accessory grips of exercise devices 100, 400, or 1700 except as further detailed below. Where possible, similar elements are identified with identical reference numerals in the depiction of the embodiments of FIGS. 4, 7, 17, 18, and 27.

In general, combination grip 2700 includes two elements which may be used as grips, which may be at one end or at both ends of the exercise device including, but not limited to, exercise device 100 or 400. Thus, for example, combination grip 2700 may be at both of ends 121, on both of ends 421, or on one of ends 421*a* or 421*b*. In the embodiment of FIG. 27, grip 2700 includes a hand grip 423*a* supported by loop 425*a* from strap 427*a*. Specifically, the material of strap 427*a* continues through loop 425*a* and is affixed to the strap by stitching 2711. Grip 2700 further includes a loop 2710 supported at end 421*a*.

In one embodiment, loop 2710 is a strap formed from one or more inelastic pieces that are attached together to form a continuous loop through portion 803, and the loop is thus integrally attached to hand grip 423. Thus, for example, hand grip 423*a* has a first end 423*a*-1 and 423*a*-2 that correspond to a first end 802-1 and a second end 803-2, respectively, of inner cylindrical tubular portion 803. In one embodiment, loop 2710 is formed from one or more pieces of webbing with ends sewed together form a single loop through portion 803, resulting in a portion of the loop hanging below the hand grip.

Figure 28:
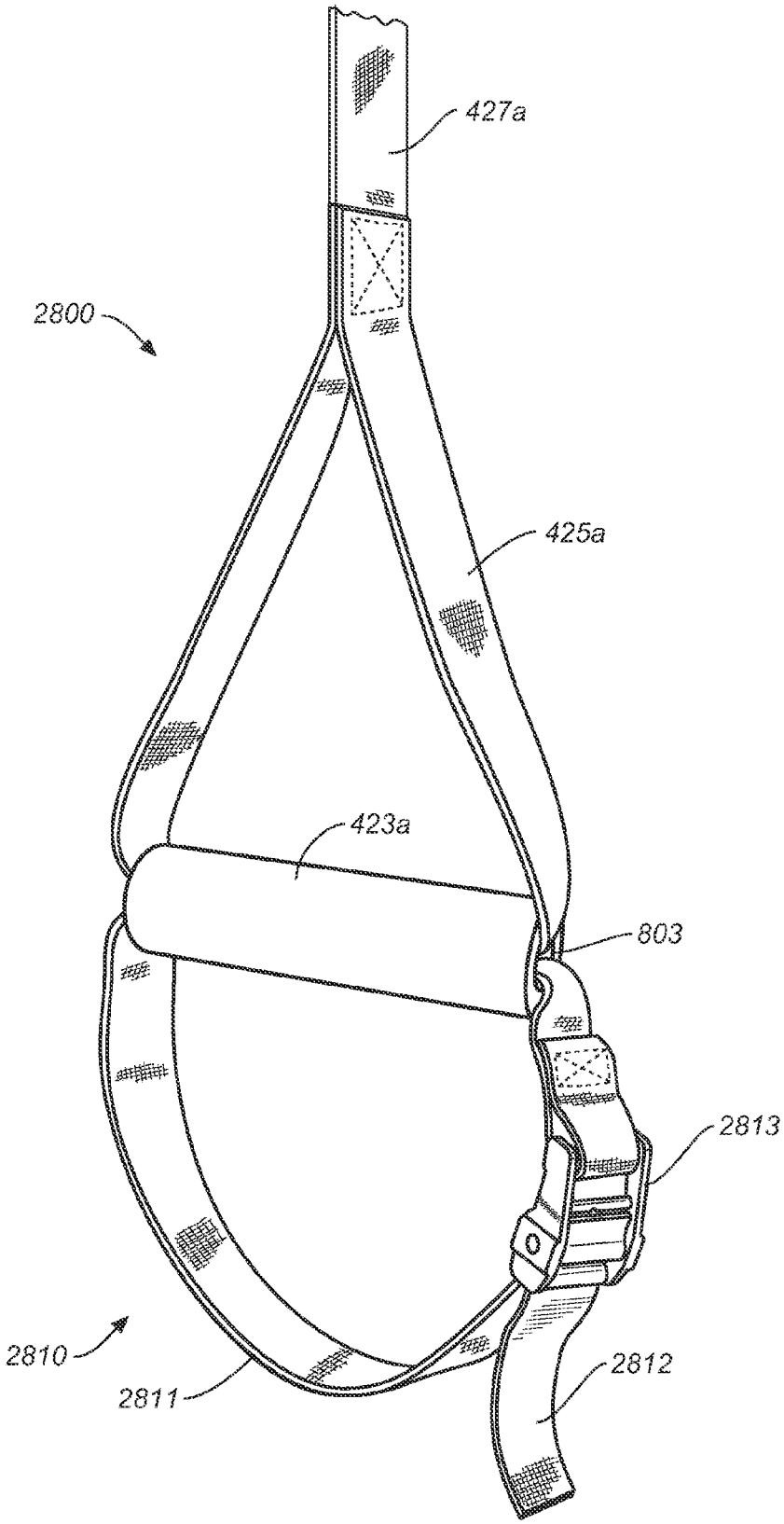
FIG. 28 is a perspective view of a second embodiment combination grip.

FIG. 28 is a perspective view of a second embodiment of a combination grip 2800 which may be generally similar to grip 2700, except as further detailed below. Where possible, similar elements are identified with identical reference numerals in the depiction of the embodiments of FIGS. 4, 7, 17, 18, 27, and 28.

Combination grip 2800 includes a flexible loop 2810 that includes a strap 2811 having an end 2812, and a length adjustment mechanism 2813. Strap 2811 passes through tubular portion 803 and length adjustment mechanism 2813 permits the size of loop 2810 to be adjusted by moving end 2812 through the mechanism. Mechanism 2813, which may be, for example, a cam buckle, as illustrated, or a VELCRO® brand hook and loop fastener, permits the user to adjust the length of loop 2810 to the user's body size. Strap 2811 may either be removable from hand grip 423*a*, or may have ends that are too large to permit removal of the grip, and thus is not removable from the hand grip. In an alternative embodiment (not shown), strap 2811 and end 2812 have matching fasteners, such as a VELCRO® brand hook and loop fastener, to prevent dangling of the strap end.

The user of a combination grip, including but not limited to one of combination grips 2700 or 2800 has the choice of exercising using either hand grip 423*a* to exercise as shown, for example, in any one of FIGS. 15A through 15I, 16A, or 16B. Alternatively, the user of combination grip 2700 or 2800, may exercise, for example, by placing one's foot between hand grip 423 and loop 2710 or 2810, similar to the use of grip 1700 as illustrated in FIG. 17A or 17B.

In one embodiment, grip 423 is 5 inches long, and loop 2710 is approximately 20 inches long. In another embodiment, a portion of loop 2710 that is not within portion 803 is padded with ⅛ inch of a soft material, including but not limited to a rubber based on polychloroprene, such as neoprene. In another embodiment, and loop 2810 is adjustable from approximately 12 inches long to approximately 23 inches long.

In yet another embodiment, loop 2711 or 2811 does not form a loop through portion 803, but is attached at or near the ends 803-1, 803-2.

Figure 19A:
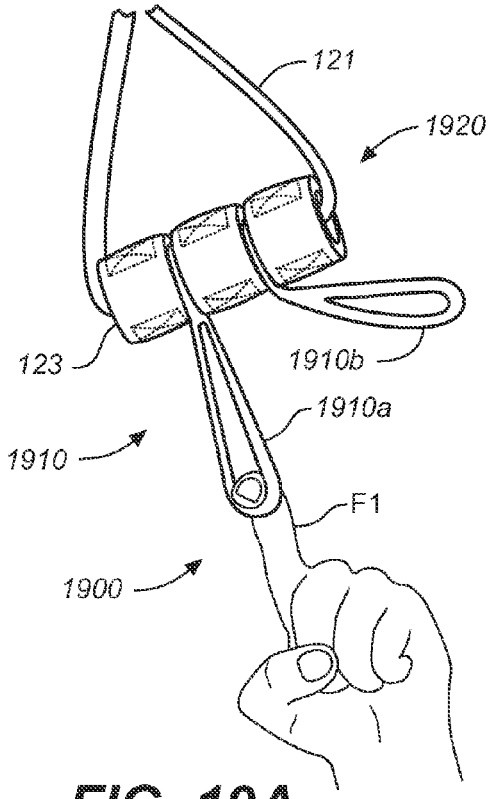
FIGS. 19A, 19B, and 19C show an embodiment of a finger grip accessory as attached to a grip of an exercise device, where
Figure 19B:
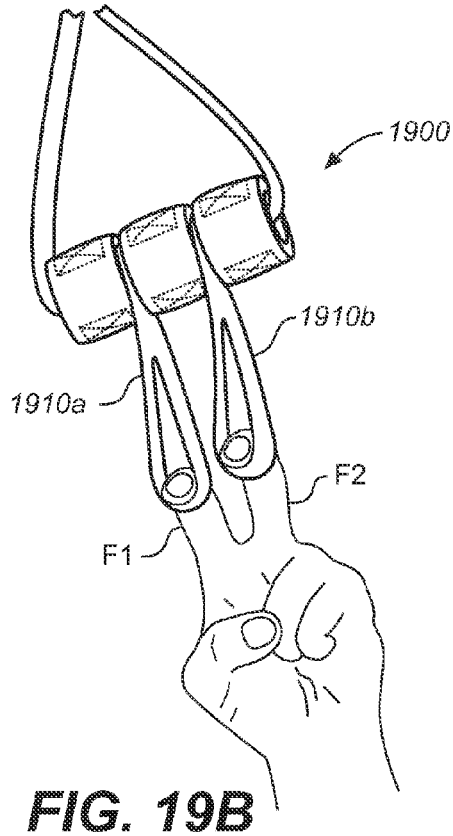
Figure 19C:
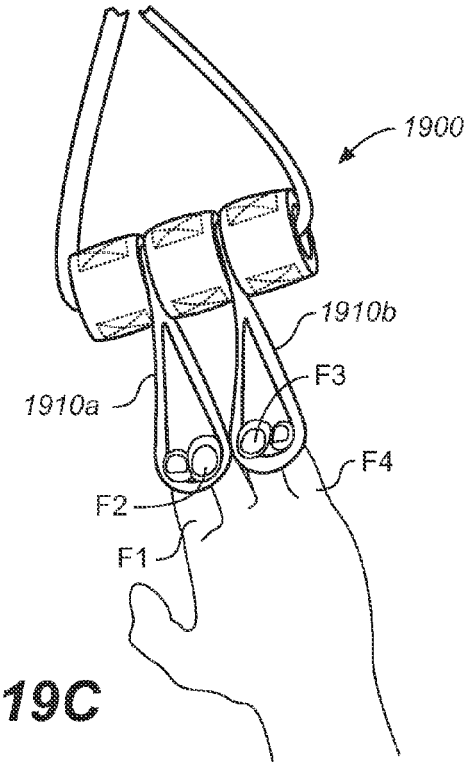

Another example of a grip accessory is finger grip accessory 1900, which is illustrated in FIGS. 19A-19C with three different exercises when attached to grips 123 of exercise device 100. Finger grip assembly 1900 has loops 1910 adapted for receiving and being gripped by the thumb and one or more fingers and a grip attachment portion 1920 for attaching the accessory to the grip of an exercise device. Grip attachment portion 1920 is removably attachable to one of the pair of grips 123. In one embodiment, there are two loops 1910: a first loop 1910*a*, and a second loop 1910*b*. With finger grip accessory 1900 so secured, a finger F1 can be placed through one of the loops, for example first loop 1910*a* as shown in FIG. 19A, a finger F1 can be placed through the first loop and a finger F2 can be placed through second loop 1910*b* as shown in FIG. 19B, or two fingers, F1 and F2 can be placed through the first loop and a finger F3 and a finger F4 can be placed through the second loop, as shown in FIG. 19C.

In one embodiment, each of the pair of grips 123 is provided with one finger grip accessory 1900. With the finger or fingers so placed through at least one of loops 1910, a force can be exerted by the pulling against exercise device 100. Finger grip accessory 1900 has similar functionality as finger grips 4001.

Figure 20A:
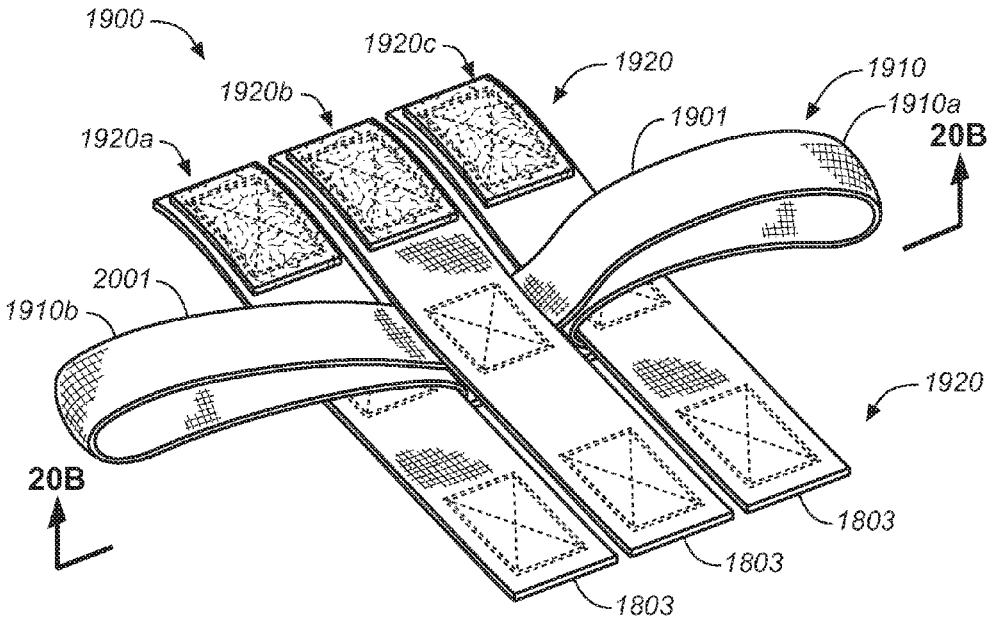
FIGS. 20A, 20B, and 20C show one embodiment of the finger grip accessory of FIGS. 19A-C, where
Figure 20B:
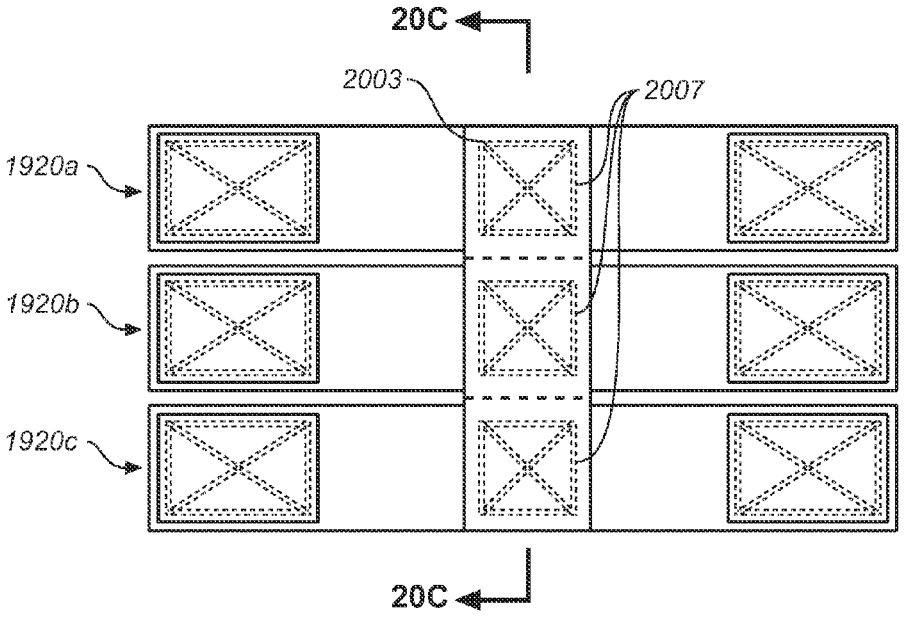
Figure 20C:
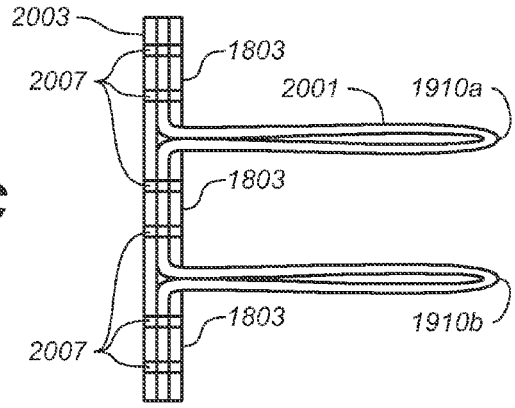

A specific embodiment of finger grip accessory 1900 is illustrated in FIGS. 20A-C, where FIG. 20A is a perspective view of the finger grip accessory, FIG. 20B is a top view 20B-20B of the finger grip accessory, and FIG. 20C is a sectional side view 20C-20C of the finger grip accessory. Finger grip accessory 1900 includes two loops 1910, first loop 1910*a* and second loop 1910*b*, and grip attachment portion 1920 includes three portions 1920*a*, 1920*b*, and 1920*c*. More specifically, finger grip accessory 1900 is formed from five straps: a loop strap 2001, three attachment straps 1803, and a backing strap 2003. With the five straps attached, as described subsequently, loop strap 2001 forms first loop 1910*a* and finger loop 1910*b*, that can each receive one or more fingers, and each of the three attachment straps 1803 forms one of grip attachment portion 1920*a*, 1920*b*, and 1920*c*. It is preferred that the majority of finger grip 1900 is formed of the same materials as hand grip 1700.

In a preferred embodiment, loop strap 2001 is constructed from a polymeric fiber webbing having a length of 21.5 inches long and a width of 1 inch, and backing strip 2003 is preferably a polymeric fiber webbing having a length of 2 inches and a width of 1 inch. Preferred attachment straps 1803 have been discussed previously. Finger grip accessory 1900 is assembled by three stitches 2007 that each pass through one of the three attachment straps 1803 and through loop strap 2001 and backing strap 2003. In the preferred embodiment, stitching 2007 is double stitched portions. As is shown in FIGS. 20A and 20C, a portion of loop strap 2001 protrudes between each of the three attachment straps 1803 to form loops 1910*a* and 1910*b*. It is preferred that loops 1910*a* and 1910*b* are formed from lengths of loop strap 1901 that are approximately 8 inches. Loop strap 2001 preferably extends the length of backing strap 2003, with two loops 1910*a* and 1910*b* between adjacent attachment straps 1803.

Finger grip accessory 1900 is removably attachable and is used as follows. Grip attachment portion 1920 of finger grip accessory 1900 is removably attachable to one of the pair of grips 123 by the contact of fastening surfaces 1809 and 1813 on each strap 1803. With finger grip accessory 1900 so secured, a finger may be placed through one of the loops, for example loop 1910*a* as shown in FIG. 20A, one finger can be placed through each of loop 1910*a* and 1910*b* as shown in FIG. 20B, or two fingers can be placed through each of loop 1910*a* and 1910*b* as shown in FIG. 20C. With the finger or fingers so placed through at least one of loops 1910, a force can be exerted by the user against exercise device 100.

Figure 21A:
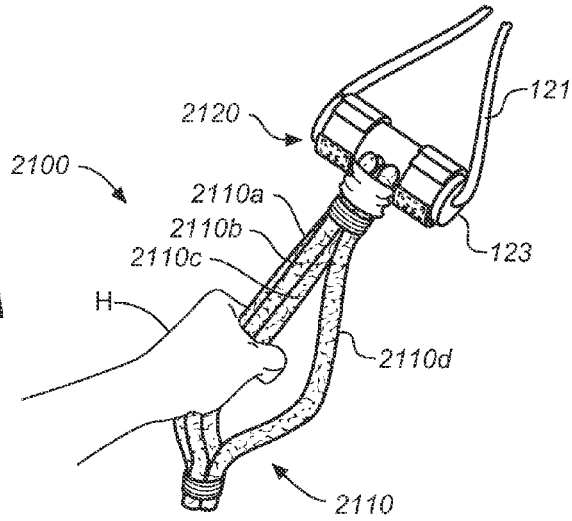
FIGS. 21A, 21B, and 21C shown an embodiment of a grip accessory as attached to a grip of an exercise device, where
Figure 21B:
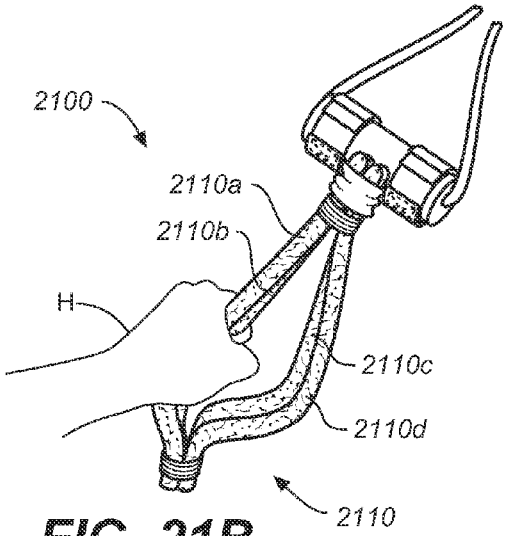
Figure 21C:
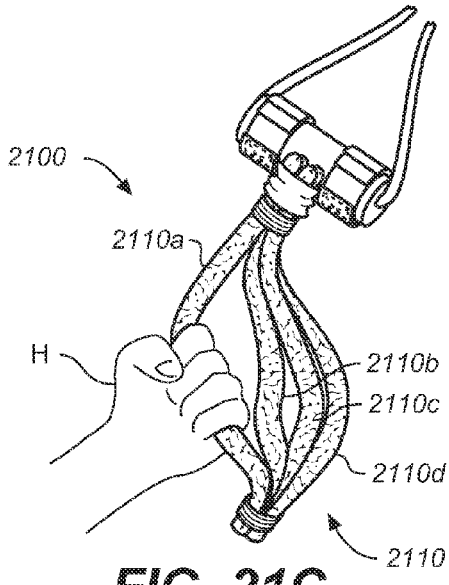

A third example of a grip accessory is grip accessory 2100, which is illustrated in FIGS. 21A-21C as being attached to grips 123 of exercise device 100. Grip accessory 2100 has several cords 2110 that can be gripped in different combinations, as explained subsequently, and a grip attachment portion 2120. In general, the number of cords 2110 can be from one to five, or more, with four being a preferred number, and with each cord having the same diameter and length. It is also preferred that the cords have a grippable length large enough for a human hand, for example a length from 4 inches to 6 inches, and that there is enough additional length to allow the user to pass her hand between cords, as illustrated in FIGS. 21A-21C. In one embodiment, grip accessory 2100 has four cords, denoted as a first cord 2110*a*, a second cord 2110*b*, a third cord 2110*c*, and a fourth cord 2110*d*. The cords can be gripped in almost any combination so that a user can grip any number of cords, from one cord to all 4 cords. FIG. 21A illustrates hand H gripping three cords, for example the first cord 2110*a*, second cord 2110*b*, and third cord 2110*c*, FIG. 21B illustrates the hand gripping two cords, for example the first and second cords, and FIG. 21C illustrates the hand gripping one cord, for example the first cord.

Grip attachment portion 2120 is removably attachable, as discussed subsequently, to one of the pair of grips 123. With grip accessory 2100 so secured, between one and all of cords 2210 can be gripped, and a force can be exerted by pulling against exercise device 100. In one embodiment, each of the pair of grips 123 is provided with one grip accessory 2100.

Figure 22A:
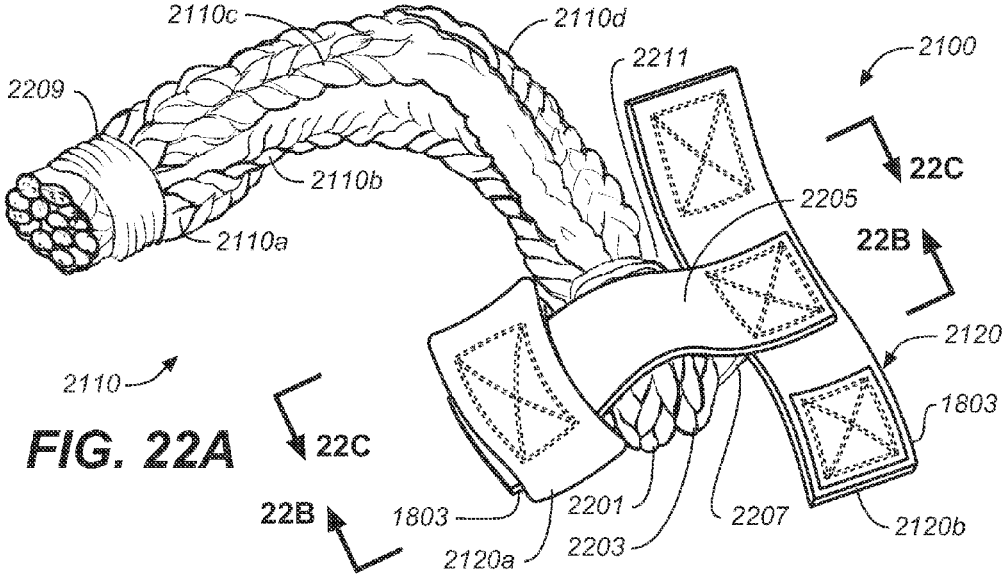
FIGS. 22A, 22B, 22C, and 22D show one embodiment of the grip accessory of FIGS. 21A-C, where
Figure 22B:
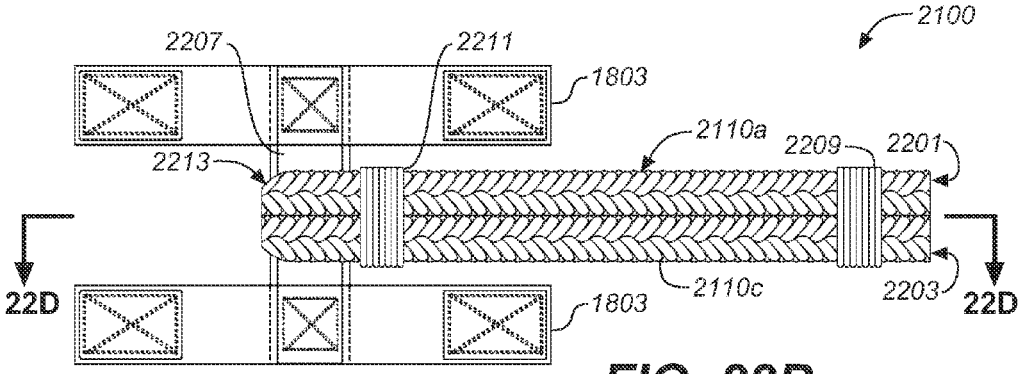
Figure 22C:
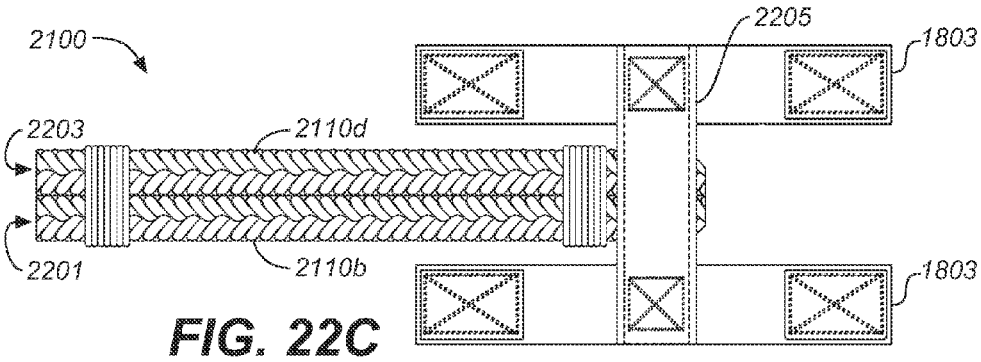
Figure 22D:
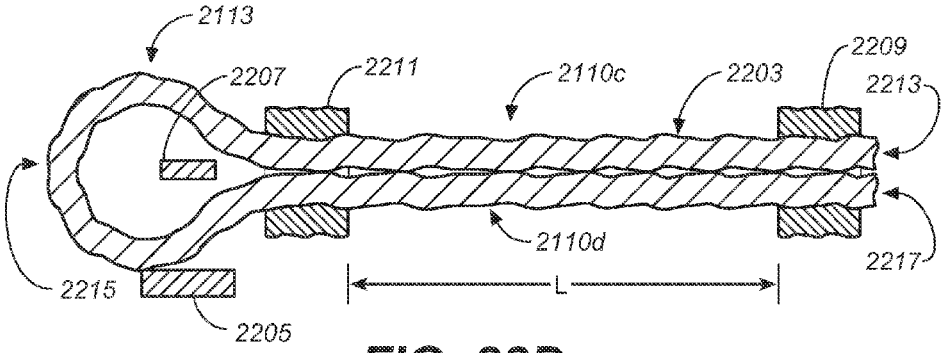

A specific embodiment of grip accessory 2100 is illustrated in FIGS. 22A-D, where FIG. 22A is a perspective view of the grip accessory, FIG. 22B is a top view of the grip accessory, FIG. 22C is a bottom view of the grip accessory, and FIG. 22D is sectional side view 22D-22D of FIG. 22C. Grip accessory 2100 is formed from four straps, specifically a backing strap 2205, a front strap 2207, and two attachment straps 1803, and two cords 2201 and 2203. Cords 2110 are formed from two longer cords 2201 and 2203, and grip attachment portion 2120 is formed from straps 2205, 2207, and 1803.

The two straps 1803 forming grip attachment portion 2120 are attached at their respective central portions between the ends of backing strap 2205 and front strap 2207. The four cords 2110*a-d* are formed from the longer cords 2201 and 2203. Specifically, as shown in FIG. 22B, cords 2101 and 2103 are side-by-side and folded in half. Each cord forms a loop 2213 near the middle of cords 2101 and 2103, with both cords lashed together by whipping 2109 and to form a loop 2113 and with the four ends of cords 2101 and 2103 lashed by whipping 2109. In the sectional view of FIG. 22D, cord 2203 is shown with a first end 2213 and second end 2217 lashed together by whipping 2209, and a central portion 2215 forming loop 2213 about strap 2207. Each cord 2101 and 2103 is folded in half, and thus each cord forms two cords between whippings 2109 and 2111. Specifically, cord 2101 form cords 2210*a* and 2210*b*, and cord 2103 forms cords 2210*c* and 2210*d*.

Straps 2105 and 2107 are preferably polymeric fiber webbings. Backing strap 2105 preferably has a length of 5 inches and a width of 1 inch, and front strap 2107 preferably has a length of 6 inches and a width of 1 inch. Cords 2101 and 2103 are preferably cotton cord having a length of from approximately 20 inches to approximately 30 inches, and more preferably from approximately 22 inches to approximately 26 inches, and still more preferably approximately 24 inches in length. Cords 2101 and 2103 have a diameter that is preferably from ½ inch to 1 inch, and more preferably approximately ¾ inches. The joints between straps 2105 and 2107 and attachment straps 1803 are preferably double stitched. The resulting grip attachment 2100 has four cords with approximately 10 inches of grippable length, allowing enough room for a human hand to pass between and grip cords 2110.

Grip accessory 2100 is removably attachable and is used as follows. Grip attachment portion 2120 is removably attachable to one of the pair of grips 123 by the contact of fastening surfaces 1809 and 1813 on each strap 1803. With finger grip accessory 2100 so secured, one, two, three, or all four of cords 2110*a-d* may be gripped by the hand. For example, FIG. 22A illustrates cords 2110*a*, 2110*b*, and 2110*c* gripped by a user, FIG. 22B illustrates cords 2110*a* and 2110*b* gripped by a user, and FIG. 22C illustrates cord 2110*a* gripped by a user. With cords 2110 so gripped, a force can be exerted by the user against exercise device 100.

Although the invention(s) presented herein have been disclosed in the context of certain preferred embodiments and examples, it will be understood by those skilled in the art that the invention(s) extend beyond the specifically disclosed embodiments to other alternative embodiments and/or uses of the invention(s) and obvious modifications and equivalents thereof. Thus, it is intended that the scope of the invention(s) herein disclosed should not be limited by the particular embodiments described above, but should be determined only by a fair reading of the claims that follow.

What is claimed is:

1. An inelastic exercise device comprising:

an elongated member having a pair of ends separated by a length and a mechanism for adjusting said length, where said elongated member is a substantially inelastic and flexible material, and where said pair of ends includes a first end having a first grip and a second end having a second grip; and an anchor having a first portion for mounting to a structure and a second portion including a flexible portion to support said elongated member at a position along said length when both of said grips are pulled in a direction away from said anchor, wherein said flexible portion includes a flexible loop, and wherein said elongated member passes through said flexible loop.

2. The exercise device of claim 1, wherein said first portion is removably attachable to a structure.

3. The exercise device of claim 2, wherein said structure is a closed door having a door jamb, wherein said anchor includes a strap that is passable between said closed door and said door jamb and where a part of said first portion is not passable between said closed door and said door jamb.

4. The exercise device of claim 3, wherein the material of said first portion that contacts said structure is softer than said structure, such that said anchor will not scratch said structure.

5. The exercise device of claim 2, wherein said structure is a pole, rail, or stanchion, wherein said first portion includes a strap and a tensioning device, wherein said strap has a length sufficiently long to wrap about said structure, and wherein said tensioning device is adapted for tightening said strap about said structure.

6. The exercise device of claim 1, wherein said first grip and said second grip are hand grips.

7. The exercise device of claim 1, wherein at least one of said first grip and said second grip is a finger grip.

8. The exercise device of claim 1, wherein at least one of said first grip and said second grip is a foot grip.

9. The exercise device of claim 1, wherein said elongated member includes at least one strap, said mechanism includes at least one buckle, such that said length is adjustable according to the length of strap through said buckle.

10. The exercise device of claim 9, said mechanism further including two buckles, wherein one of two buckles is adjacent to said first grip and wherein the other of said two buckles is adjacent to said second grip.

11. The exercise device of claim 1, wherein said length of said elongated member is adjustable between 6 feet and 12 feet.

12. An inelastic exercise device comprising:

an elongated member having a pair of ends separated by a length, said pair of ends including a first end having a first grip and a second end having a second grip, wherein said elongated member includes at least one inelastic, flat strap; and an anchor having a first portion for mounting to a structure and a second portion including a flexible portion to support said elongated member at a position along said length when both of said grips are pulled in a direction away from said anchor, wherein said flexible portion includes a flexible loop, and wherein said elongated member passes through said flexible loop.

13. The exercise device of claim 12, wherein said first portion is removably attachable to a structure.

14. The exercise device of claim 13, wherein said structure is a closed door having a door jamb, wherein said anchor includes a strap that is passable between said closed door and said door jamb and where a part of said first portion is not passable between said closed door and said door jamb.

15. The exercise device of claim 14, wherein the material of said first portion that contacts said structure is softer than said structure, such that said anchor will not scratch said structure.

16. The exercise device of claim 13, wherein said structure is a pole, rail, or stanchion, wherein said first portion includes a strap and a tensioning device, wherein said strap has a length sufficiently long to wrap about said structure, and wherein said tensioning device is adapted for tightening said strap about said structure.

17. The exercise device of claim 12, wherein said first grip and said second grip are hand grips.

18. The exercise device of claim 12, wherein at least one of said first grip and said second grip is a finger grip.

19. The exercise device of claim 12, wherein at least one of said first grip and said second grip is a foot grip.

20. The exercise device of claim 12, wherein said length of said elongated member is between 6 feet and 12 feet.

* * * * *